US008157115B2

(12) United States Patent
Rho

(10) Patent No.: US 8,157,115 B2
(45) Date of Patent: Apr. 17, 2012

(54) CHILD-RESISTANT CAP HAVING INNER AND OUTER CAPS AND A SEAL REMOVING UNIT

(76) Inventor: Hee Kwon Rho, Kyeongki-do (KR)

( * ) Notice: Subject to any disclaimer, the term of this patent is extended or adjusted under 35 U.S.C. 154(b) by 1157 days.

(21) Appl. No.: 11/908,452

(22) PCT Filed: Mar. 6, 2006

(86) PCT No.: PCT/KR2006/000764

§ 371 (c)(1),
(2), (4) Date: Sep. 12, 2007

(87) PCT Pub. No.: WO2006/098559

PCT Pub. Date: Sep. 21, 2006

(65) Prior Publication Data

US 2008/0164234 A1 Jul. 10, 2008

(30) Foreign Application Priority Data

Mar. 15, 2005 (KR) ..... 10-2005-0021243
Mar. 31, 2005 (KR) ..... 10-2005-0027060
Apr. 27, 2005 (KR) ..... 10-2005-0034870
Jun. 14, 2005 (KR) ..... 10-2005-0050807

(51) Int. Cl.
*B65D 55/02* (2006.01)
*B65D 17/44* (2006.01)
*B65D 51/20* (2006.01)
*B65D 47/10* (2006.01)
*B67D 1/00* (2006.01)

(52) U.S. Cl. ..... 215/220; 215/297; 220/258.4; 220/278; 222/83; 222/541.8

(58) Field of Classification Search ..... 220/277, 220/278, 254.8, 258.4; 215/228, 217, 220, 215/295, 297, 334, 204; 222/91, 83, 81, 222/541.8

See application file for complete search history.

(56) References Cited

U.S. PATENT DOCUMENTS 4,284,201 A * 8/1981 Nixon ..... 215/220
(Continued)

FOREIGN PATENT DOCUMENTS

KR 2003-0063325 7/2003

OTHER PUBLICATIONS

International Search Report dated Jul. 10, 2006 issued in corresponding PCT Application No. PCT/KR2006/000764.

*Primary Examiner* — Robin Hylton
(74) *Attorney, Agent, or Firm* — Ostrolenk Faber LLP

(57) ABSTRACT

A child-resistant cap comprises: an inner cap mounted at a vessel inlet of a vessel; an outer cap disposed at an outer circumferential surface of the inner cap so as to perform an idling with the inner cap; a rotation force transmitting portion disposed between the inner cap and the outer cap for transmitting a rotation force of the outer cap to the inner cap only when the outer cap is downwardly moved with a force more than a certain degree; and a sealing member removing unit formed at the inner cap for removing a sealing member sealed at the vessel inlet when the inner cap is detached from the vessel inlet, and storing the removed sealing member in the inner cap. Since the sealing member removing unit is integrally formed at the cap, the sealing member is automatically removed at the time of opening the cap. Accordingly, the sealing member needs not to be additionally removed, and thus a usage convenience is enhanced. Furthermore, under a construction that the outer cap maintains an upwardly moved position from the inner cap by an elastic force, the cap can be opened only by downwardly moving the outer cap with a force more than a certain degree. Accordingly, a child can be more effectively protected.

11 Claims, 17 Drawing Sheets

U.S. PATENT DOCUMENTS 4,364,484 A 12/1982 Kinsley
5,020,681 A * 6/1991 Kusz ..... 215/220
6,386,385 B1 * 5/2002 Amanat et al. ..... 220/258.4
6,435,341 B1 8/2002 Nobbio

* cited by examiner

[Fig. 3]
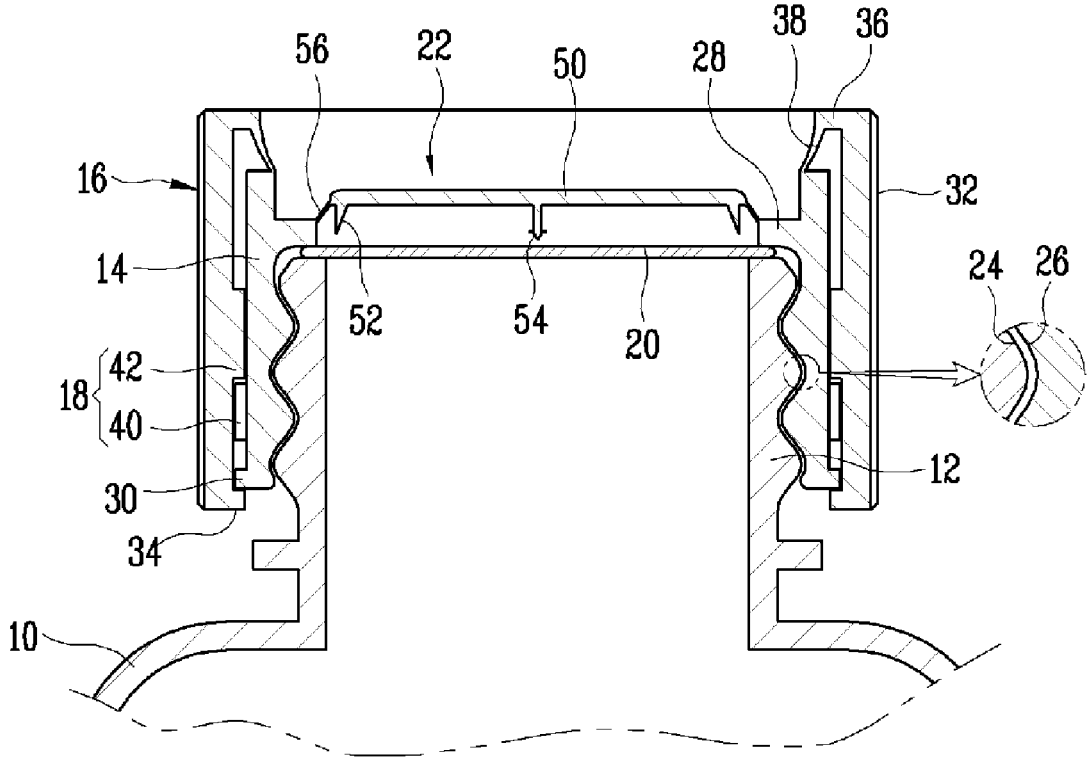

[Fig. 4]
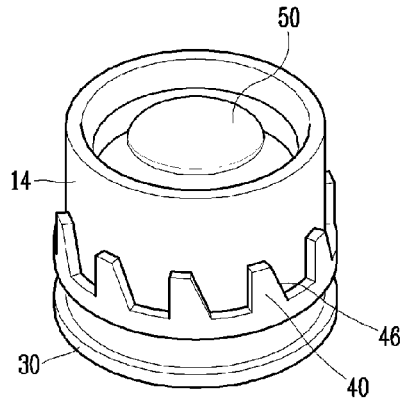
[Fig. 5]
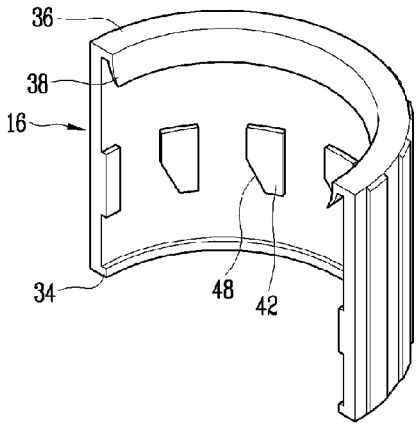
[Fig. 6]
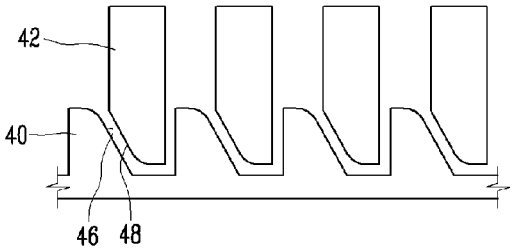
[Fig. 7]
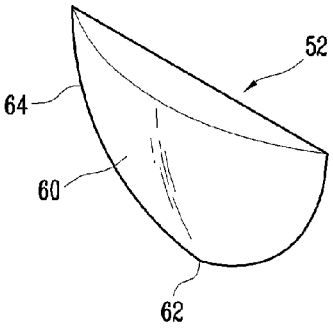

[Fig. 8]
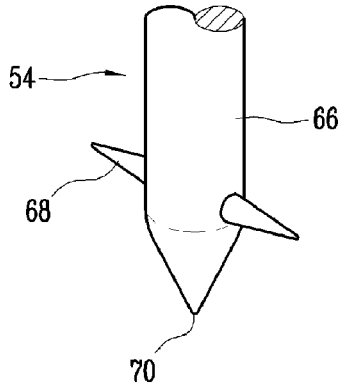
[Fig. 9]
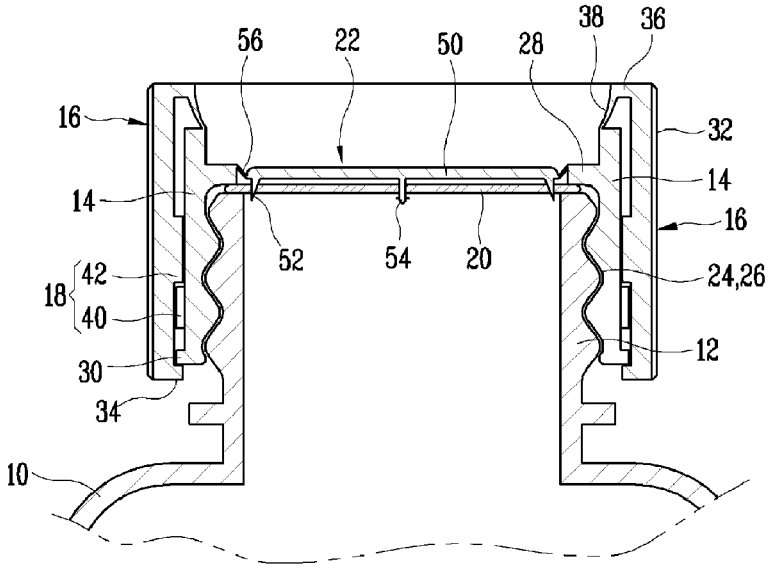
[Fig. 10]
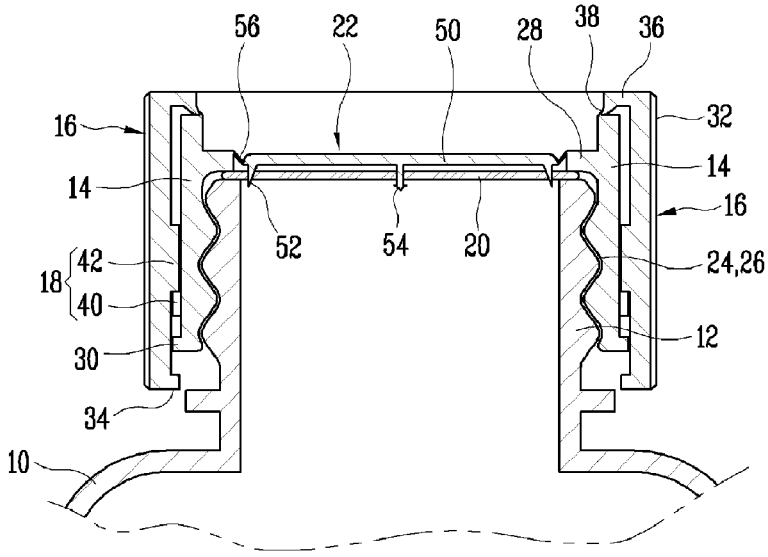

[Fig. 11]
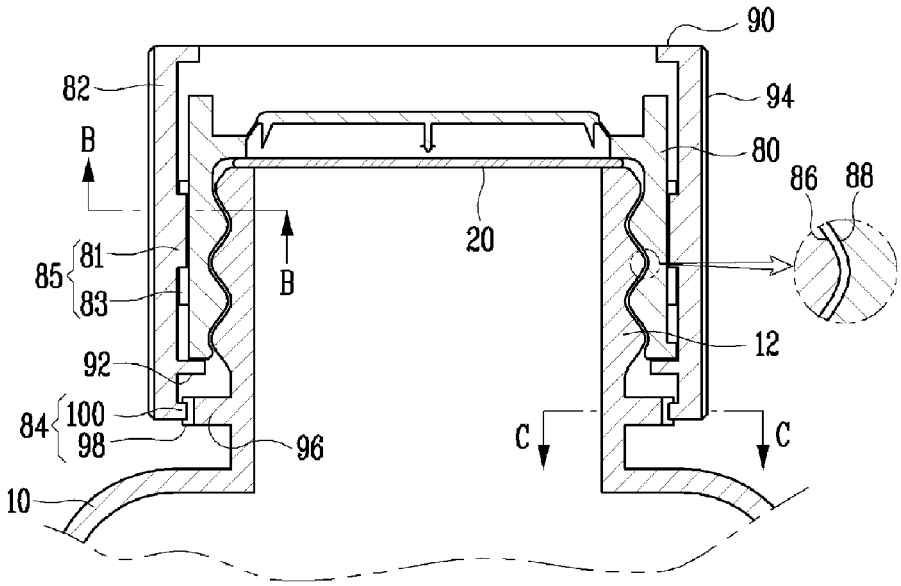
[Fig. 12]
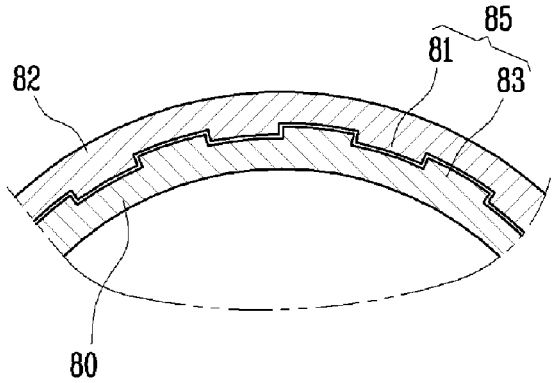
[Fig. 13]
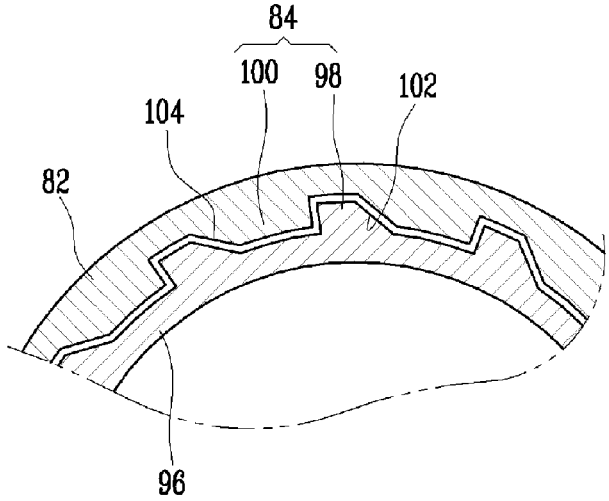

[Fig. 14]
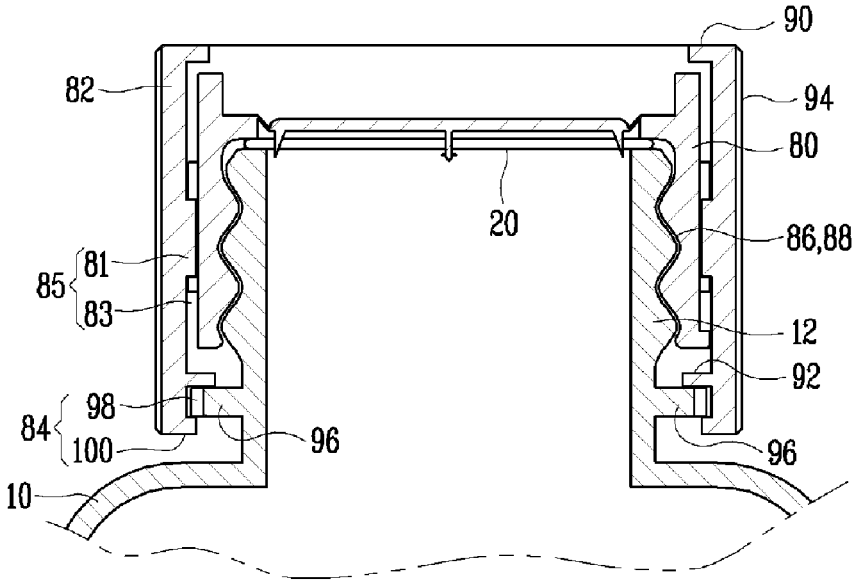
[Fig. 15]
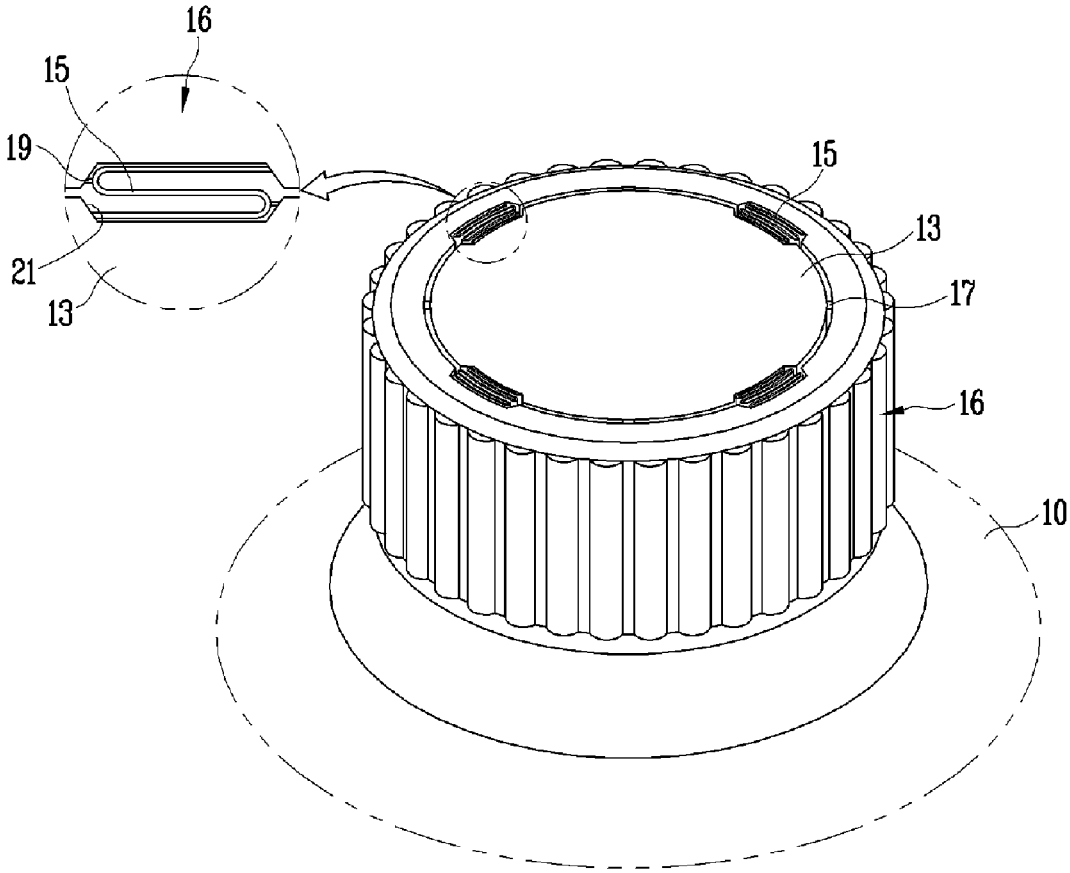

[Fig. 18]
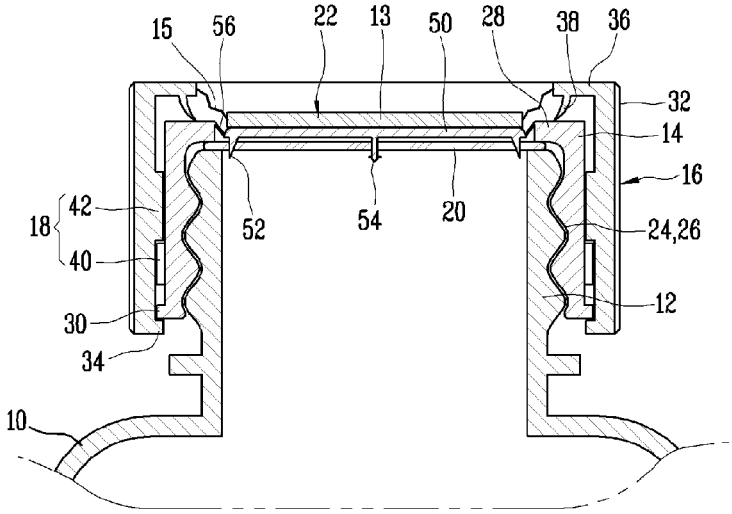
[Fig. 19]
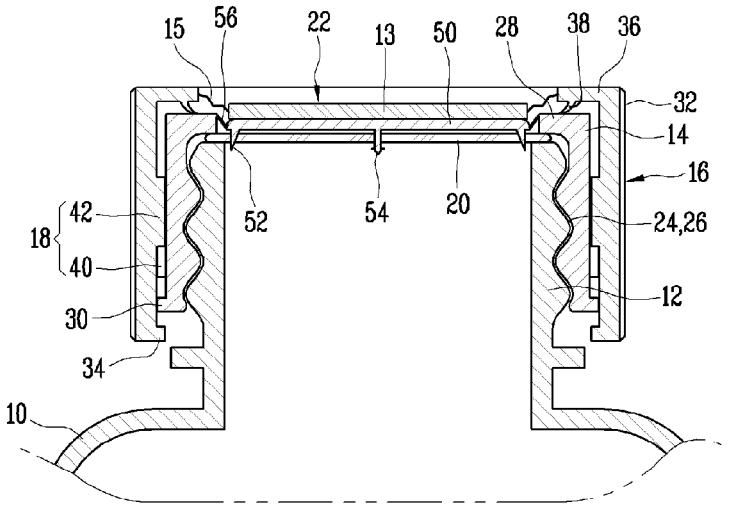
[Fig. 20]
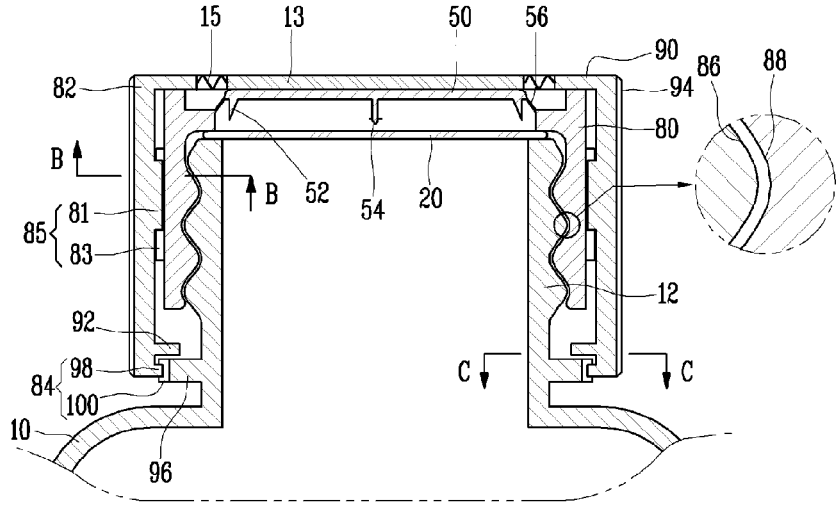

[Fig. 21]
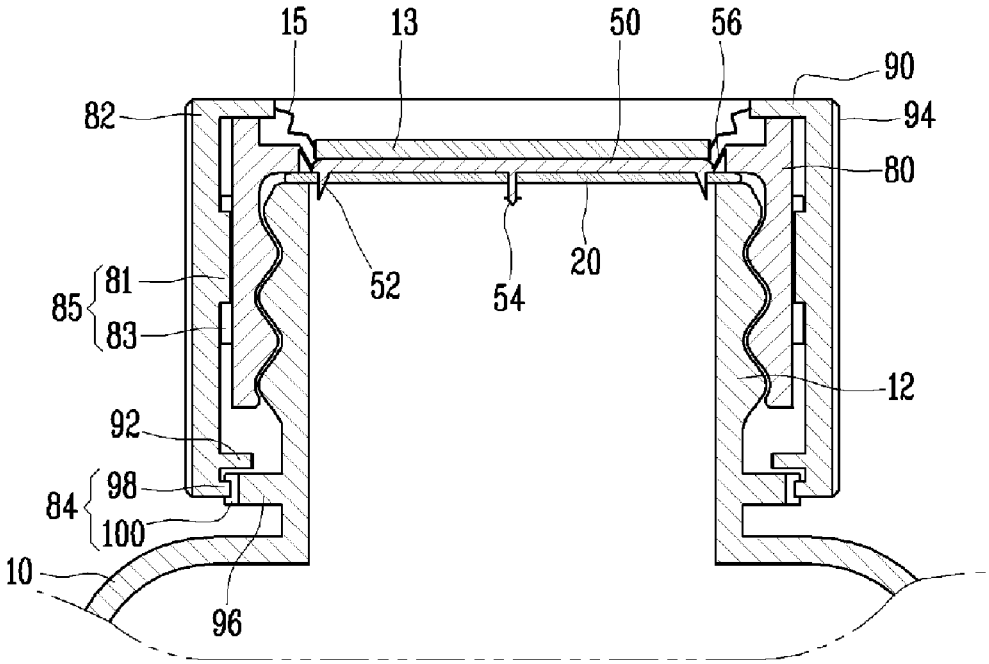
[Fig. 22]
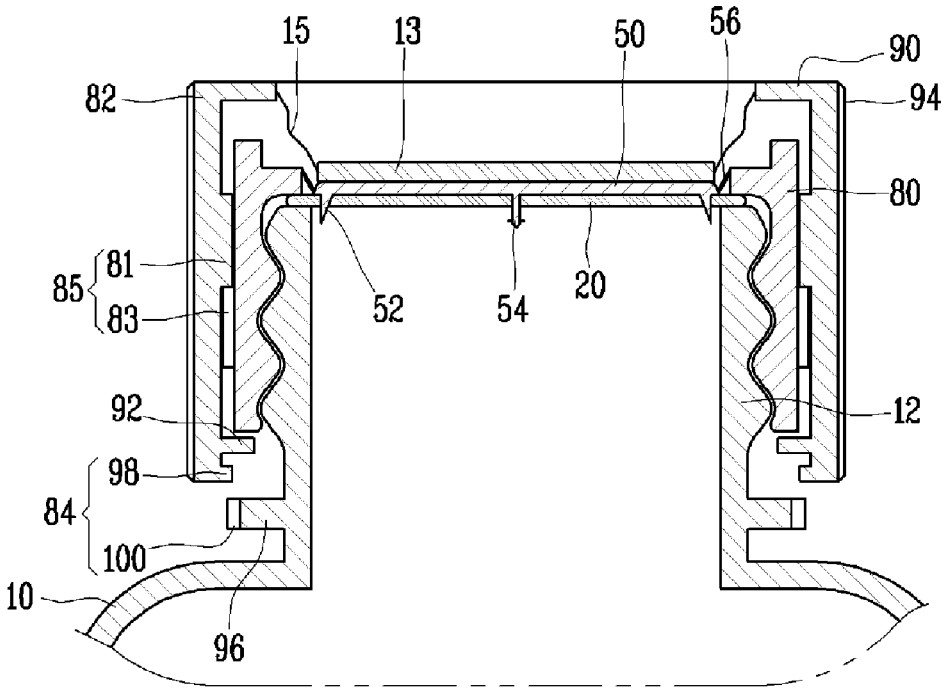

[Fig. 23]
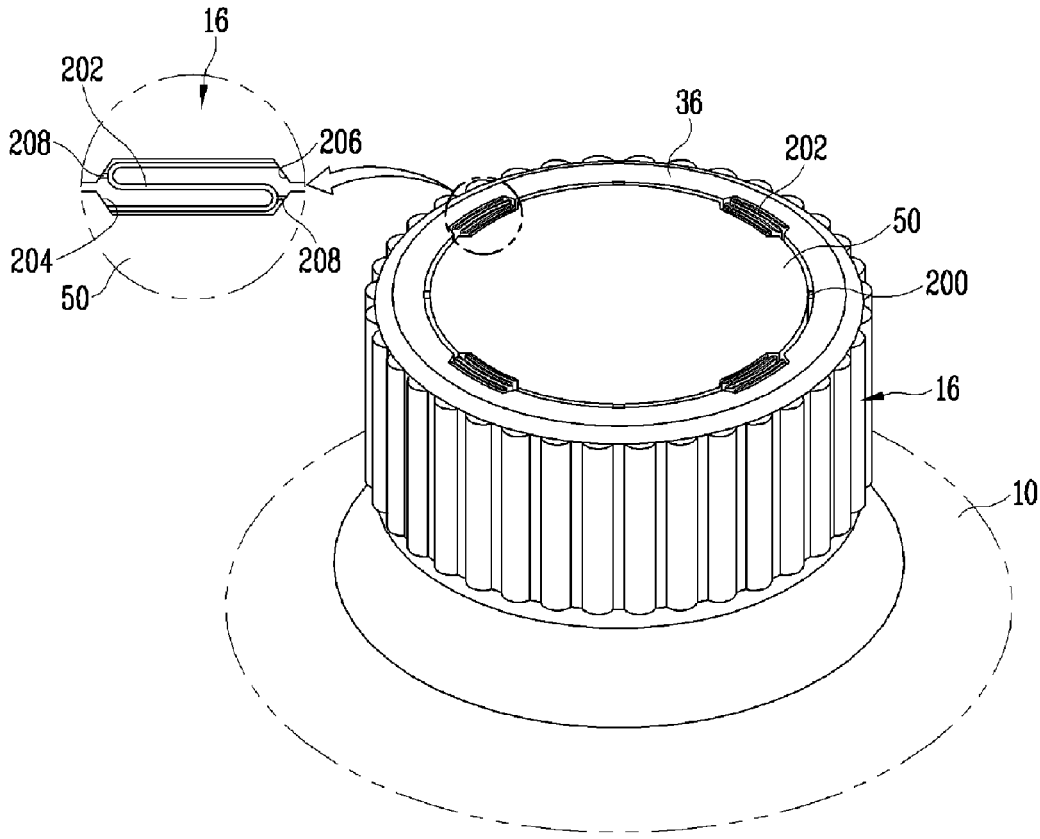
[Fig. 24]
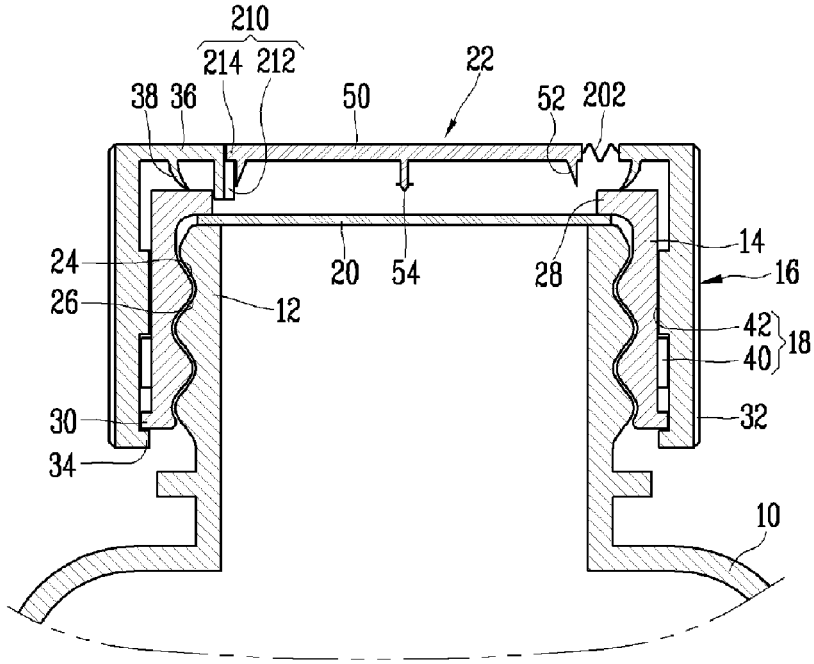

[Fig. 25]
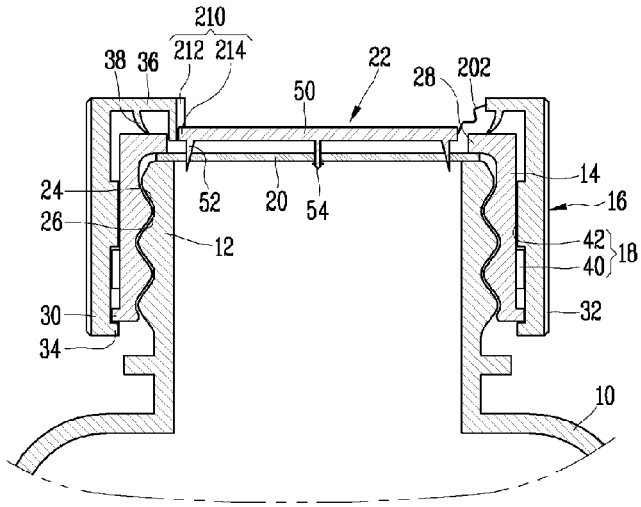
[Fig. 26]
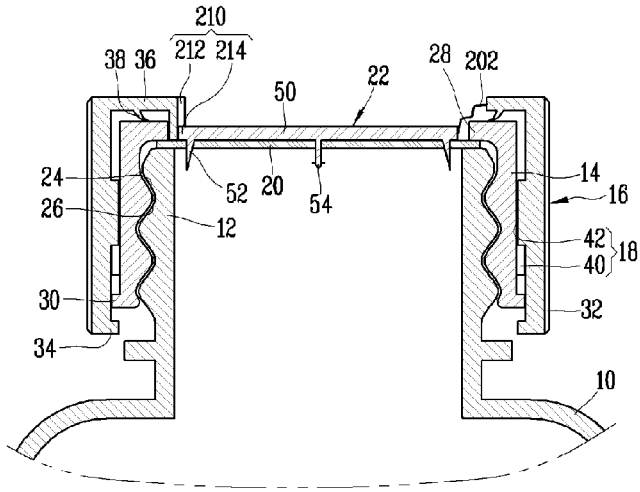
[Fig. 27]
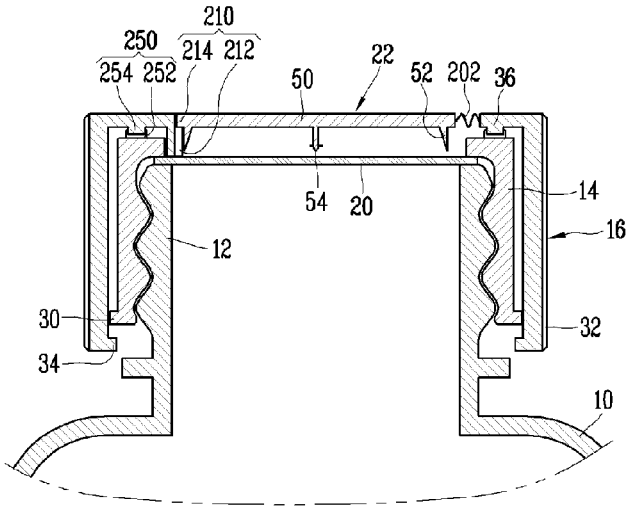

[Fig. 28]
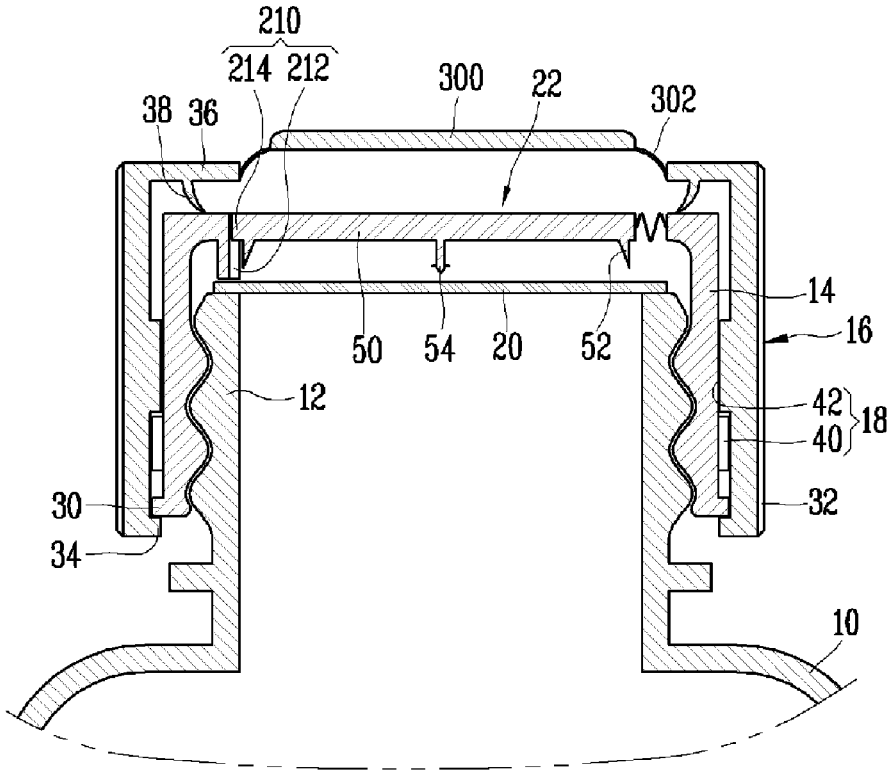
[Fig. 29]
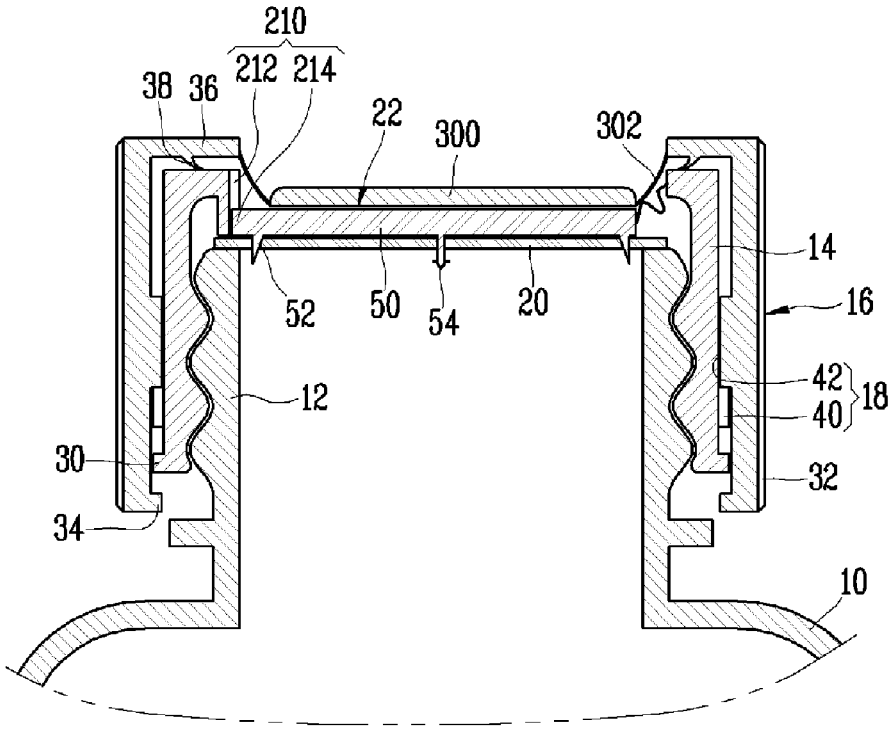

[Fig. 30]
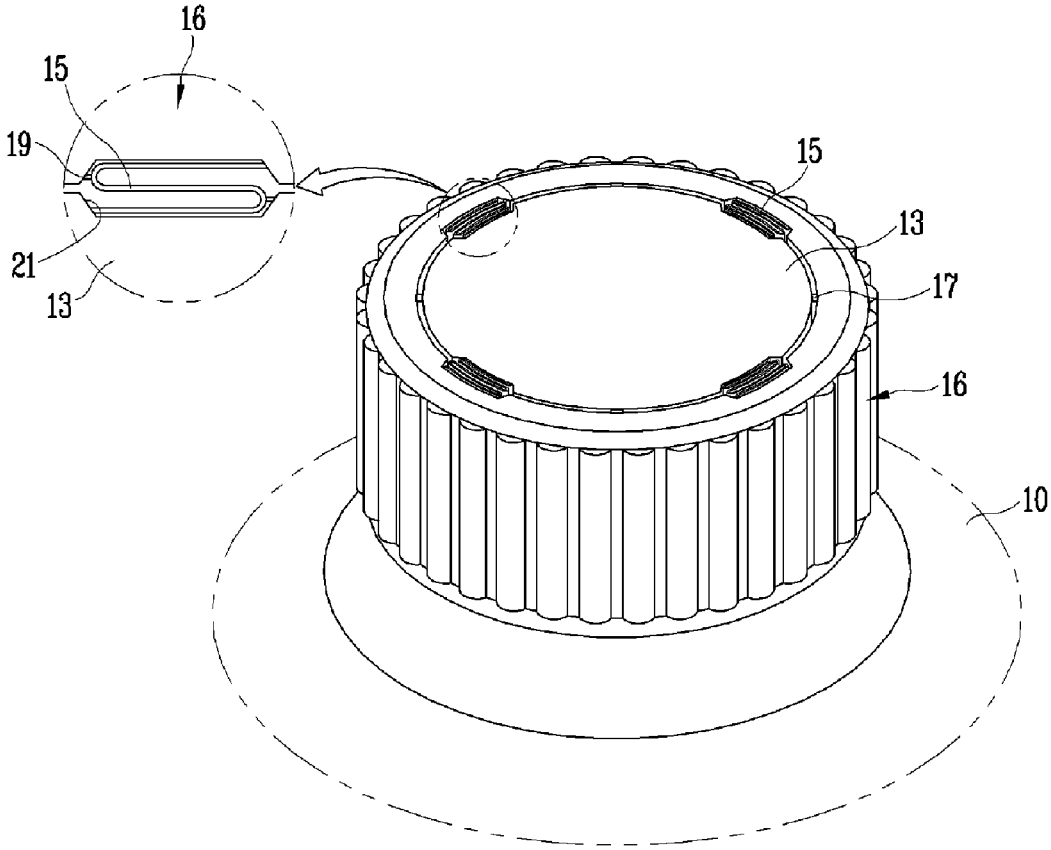
[Fig. 31]
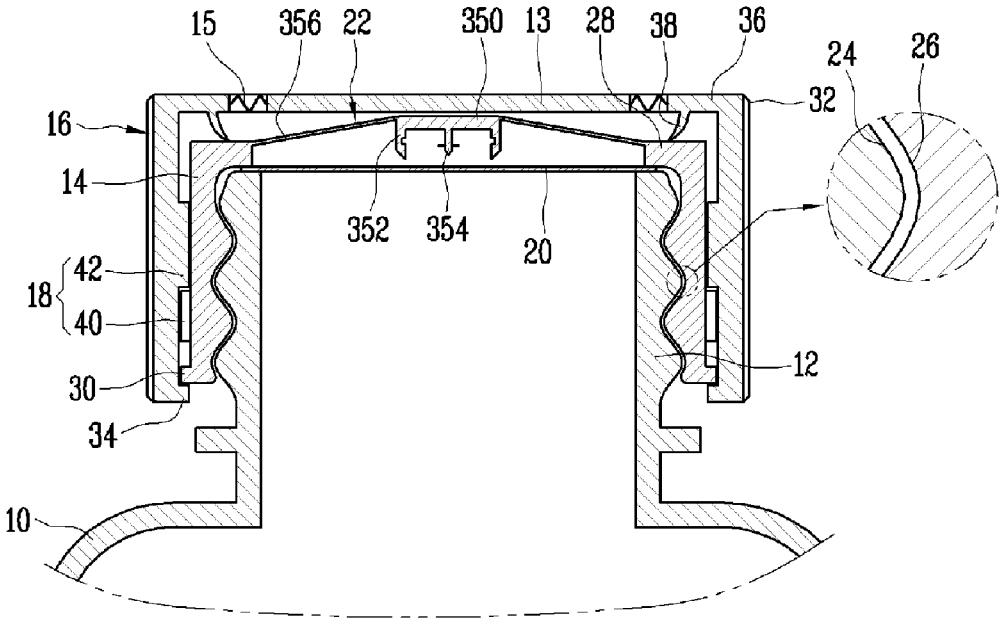

[Fig. 32]
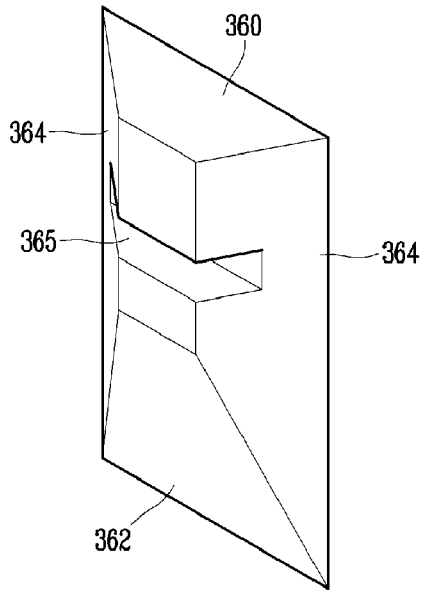
[Fig. 33]
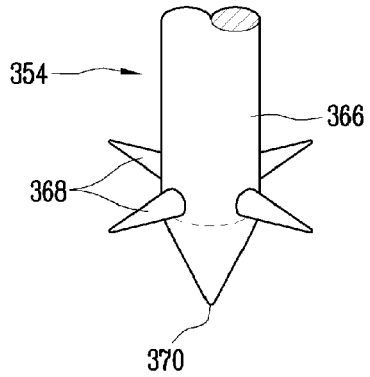
[Fig. 34]
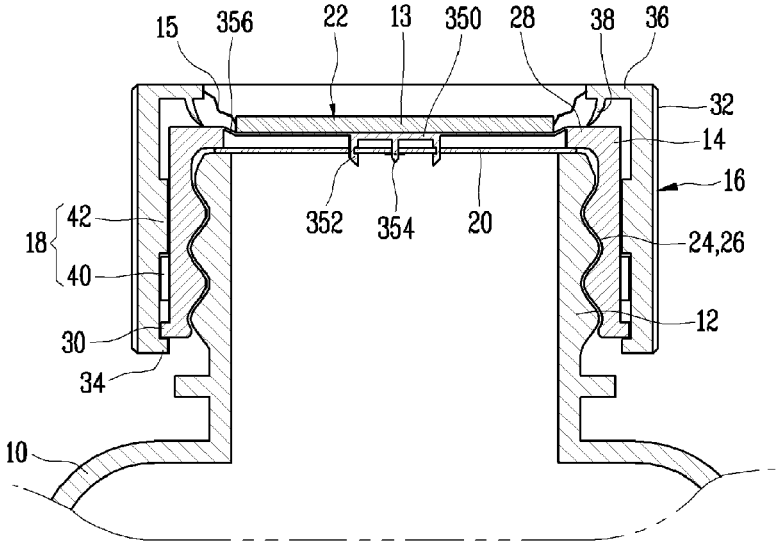

[Fig. 35]
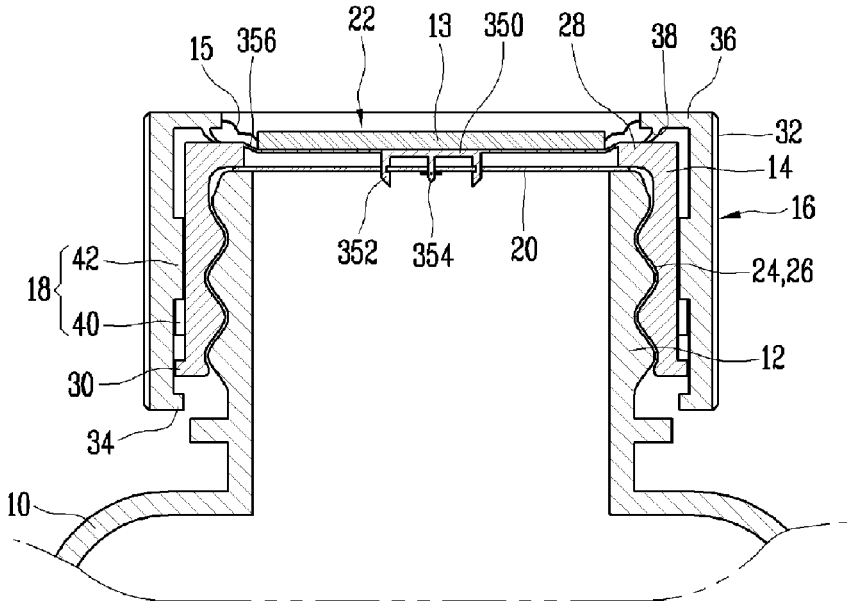
[Fig. 36]
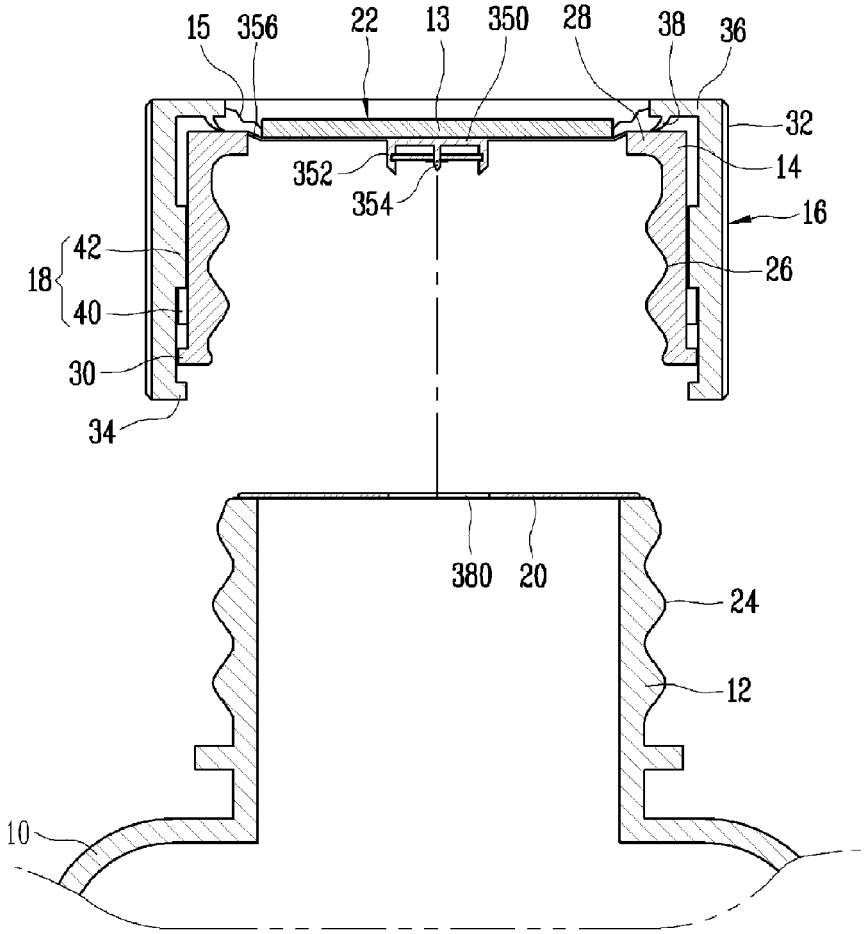

[Fig. 37]
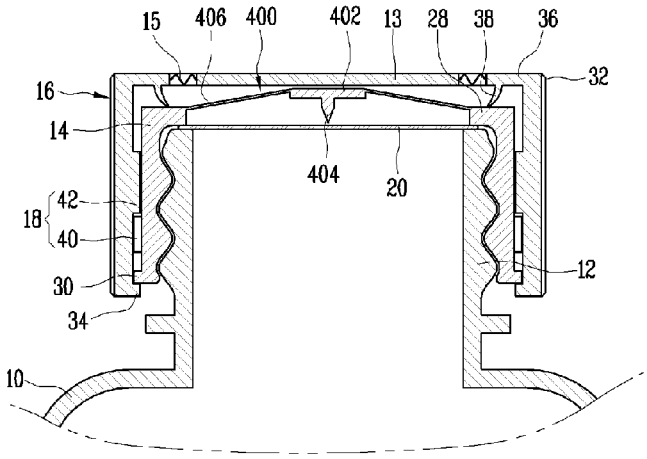
[Fig. 38]
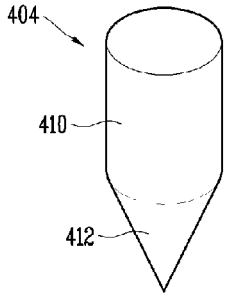
[Fig. 39]
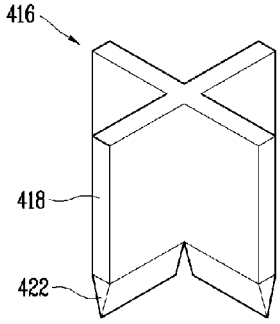
[Fig. 40]
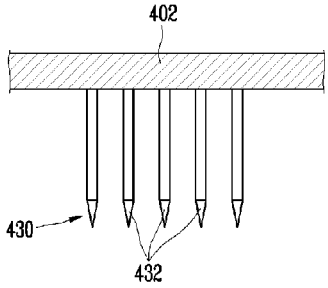

[Fig. 41]
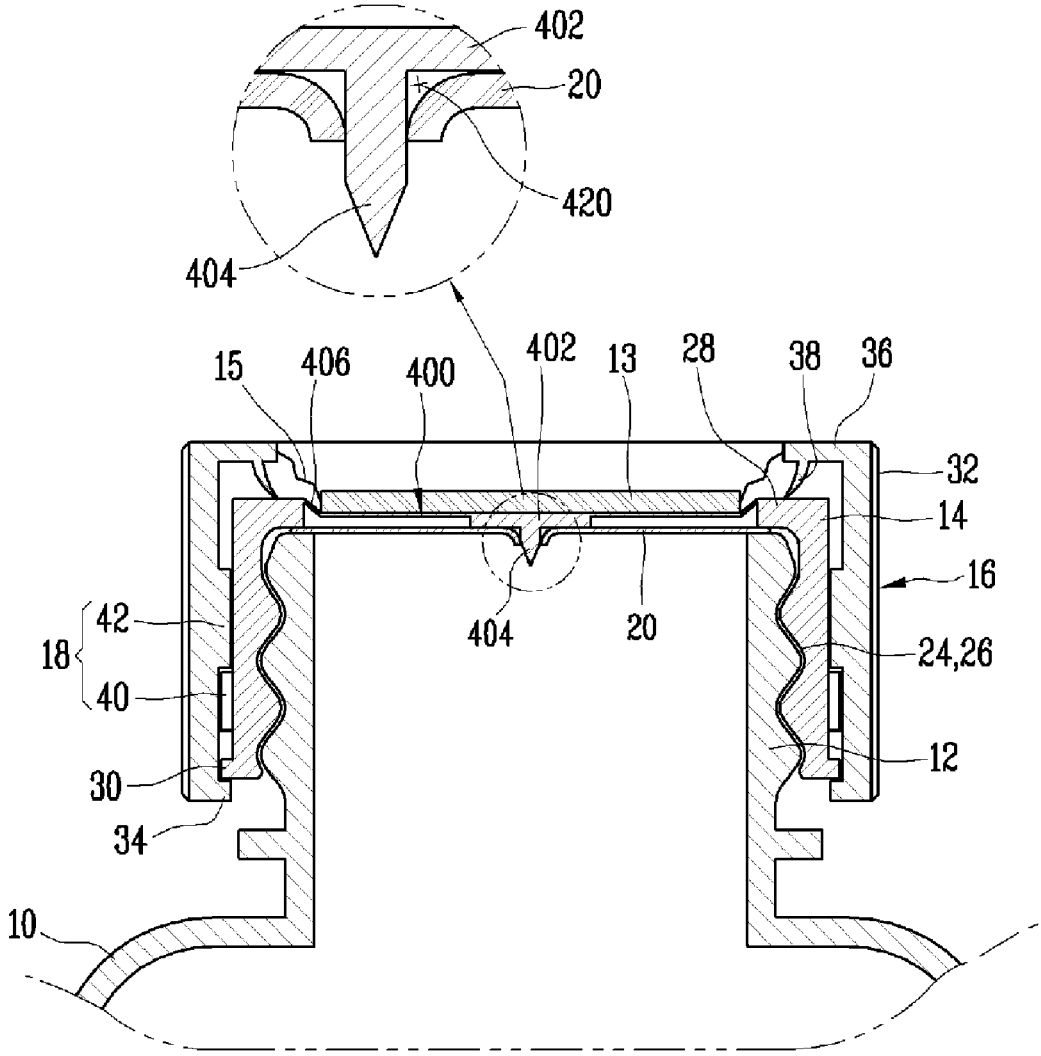

CHILD-RESISTANT CAP HAVING INNER AND OUTER CAPS AND A SEAL REMOVING UNIT

CROSS REFERENCE TO RELATED APPLICATION

The present application is a 35 U.S.C. §§371 national phase conversion of PCT/KR2006/000764, filed Mar. 6, 2006, which claims priority of Korean Application No. 10-2005-0021243, filed Mar. 15, 2005, Korean Application No. 10-2005-0027060, filed Mar. 31, 2005, Korean Application No. 10-2005-0034870, filed Apr. 27, 2005 and Korean Application No. 10-2005-0050807, filed Jun. 14, 2005 the disclosure of which has been incorporated herein by reference. The PCT International Application was published in the English language.

TECHNICAL FIELD

The present invention relates to a child-resistant cap for protecting a child from contents stored in a vessel, and more particularly, to a child-resistant cap capable of facilitating a usage by separating a sealing member sealed at a vessel inlet from the vessel with the cap at the time of opening the cap, and capable of protecting a child more effectively from the contents.

BACKGROUND ART

Recently, a vessel for storing a poisonous drug, a vessel for storing a detergent, a vessel for storing a domestic medicine, etc. are required to be equipped with a child-resistant cap for preventing a child from easily opening a cap.

FIG. 1 is a sectional view of a child-resistant cap in accordance with the conventional art.

The conventional child-resistant cap comprises an inner cap 154 mounted at a vessel inlet 152 formed at a vessel 150 and through which contents inside the vessel 150 is discharged, an outer cap 156 disposed outside the inner cap 154 and moving the inner cap 154 in upper and lower directions within a certain range, and a rotation force transmitting portion 160 formed between the inner cap 154 and the outer cap 156 for transmitting a rotation force of the outer cap 156 to the inner cap 154 only when the outer cap 156 is downwardly pressed and thereby rotating the inner cap 154.

A sealing member 170 for protecting the contents inside the vessel 150 is attached to an upper surface of the vessel inlet 152 of the vessel 150.

A female screw portion 174 screw-coupled to a male screw portion 172 formed at an outer circumferential surface of the vessel inlet 152 is formed at a lower side of the inner cap 154. Also, a stopping jaw 178 for preventing the inner cap 154 from being separated from the outer cap 156 is protruding from an inner circumferential surface of a lower end of the outer cap 156.

The rotation force transmitting portion 160 comprises a first hooking protrusion 164 radially disposed at an outer upper surface of the inner cap 154 with a certain gap and upwardly protruding with a certain width, and a second hooking protrusion 166 radially disposed at an inner upper surface of the outer cap 156 with a certain gap and downwardly protruding with a certain width thus to be locked by the first hooking protrusion 164.

According to the conventional child-resistant cap, the outer cap 156 performs an idling at the outer circumferential surface of the inner cap 154 under a state that the inner cap 154 is mounted at the vessel inlet 152. Therefore, even when the outer cap 156 is rotated by a child, the rotation force of the outer cap 156 is not transmitted to the inner cap 154 and thereby the child can not easily open the outer cap 156.

When the outer cap 156 is downwardly pressed to open the cap, the second hooking protrusion 166 formed at the outer cap 156 is inserted between the first hooking protrusions 164 formed at the inner cap 154 thus to be engaged with each other. Under the state, if the outer cap 156 is rotated, the rotation force of the outer cap 156 is transmitted to the inner cap 154. As the result, the inner cap 154 is also rotated, and is separated from the vessel inlet 152.

The cap is separated from the vessel inlet 152, and then the sealing member 170 sealed at the vessel inlet 152 is removed by a user's hand or an additional tool such as a knife, etc. Then, the contents stored in the vessel 150 is discharged through the vessel inlet 152.

However, in the conventional child-resistant cap, since the sealing member 170 attached to the vessel inlet 152 has to be removed by a user's hand or an additional tool such as a knife, etc. after separating the vessel cap from the vessel 150, a usage inconvenience is caused.

Also, at the time of removing the sealing member 170 by the user's hand, the sealing member 170 is not smoothly separated from an edge of the vessel inlet 152 due to a strong adhesive force therebetween. As the result, the use has to remove the sealing member 170 again by his hand. Herein, as the user's hand comes in contact with the vessel inlet 152, a sanitary problem may be caused.

Furthermore, in the conventional child-resistant cap, the hooking protrusions 164 and 166 are respectively formed at upper sides of the inner cap 154 and the outer cap 156, and there is no structure to upwardly lift the outer cap 156. As the result, the outer cap 156 is downwardly moved by a self weight, and the second hooking protrusion 166 of the outer cap 156 is engaged with the first hooking protrusion 164 of the inner cap 154. Accordingly, a problem that the cap is opened by a child is sometimes caused.

DISCLOSURE OF INVENTION

Technical Problem

Therefore, an object of the present invention is to provide a child-resistant cap capable of facilitating a usage by automatically removing a sealing member at the time of opening the cap by integrally forming a sealing member removing unit at the cap.

Another object of the present invention is to provide a child-resistant cap capable of solving a sanitary problem caused when a user's hand comes in contact with a vessel inlet so as to remove a sealing member by automatically removing the sealing member by a sealing member removing unit.

Still another object of the present invention is to provide a child-resistant cap capable of effectively protecting a child by opening the cap only by downwardly moving an outer cap with a force more than a certain degree under a state that an upwardly moved state of the outer cap from an inner cap is maintained by an elastic force.

Yet another object of the present invention is to provide a child-resistant cap capable of preventing a sealing member removing unit from being pressed by an external force by protecting the sealing member removing unit mounted at an inner cap by installing a protection plate for protecting the sealing member removing unit at an upper surface of an outer cap.

Yet still another object of the present invention is to provide a child-resistant cap capable of enhancing a safety by allowing a child to drink contents inside a vessel little by little when the cap is opened by mistake by discharging the contents little by little through a small hole formed at a vessel inlet by forming the hole at a sealing member by partially removing the sealing member.

Technical Solution

To achieve these and other advantages and in accordance with the purpose of the present invention, as embodied and broadly described herein, there is provided a child-resistant cap, comprising: an inner cap mounted at a vessel inlet of a vessel; an outer cap disposed at an outer circumferential surface of the inner cap so as to perform an idling with the inner cap; a rotation force transmitting portion disposed between the inner cap and the outer cap for transmitting a rotation force of the outer cap to the inner cap only when the outer cap is downwardly moved with a force more than a certain degree; and a sealing member removing unit formed at the inner cap for removing a sealing member sealed at the vessel inlet when the inner cap is detached from the vessel inlet, and storing the removed sealing member in the inner cap.

An elastic member supported by an upper surface of the inner cap and providing an elastic force to allow the outer cap to maintain an upwardly moved state from the inner cap is formed at an upper end of the outer cap.

The rotation force transmitting portion comprises a first hooking protrusion protruding from a lower outer circumferential surface of the inner cap in a circumferential direction with the same gap with a certain width; and a second hooking protrusion protruding from an inner circumferential surface of the outer cap in a circumferential direction with the same gap with a certain width, and engaged with the first hooking protrusions when the outer cap is downwardly pressed.

The sealing member removing unit comprises a pressing plate disposed in the inner cap so as to be movable in upper and lower directions; a cutter formed at an edge of a lower surface of the pressing plate in a circumferential direction for penetrating the sea ling member when the pressing plate is pressed and cutting the sealing member when the inner cap is rotated; a hooking portion downwardly protruding at the lower surface of the pressing plate for storing the sealing member cut by the cutter in the inner cap; and a connection portion formed between an outer circumferential surface of the pressing plate and an inner circumferential surface of the inner cap and elastically transformed so that the pressing plate can be movable in upper and lower directions.

According to another embodiment of the present invention, the child-resistant cap comprises: an inner cap mounted at a vessel inlet of a vessel through which contents stored in the vessel is discharged outwardly; an outer cap disposed at an outer circumferential surface of the inner cap so as to be movable in upper and lower directions; a spline portion formed between an outer circumferential surface of the inner cap and an inner circumferential surface of the outer cap for transmitting a rotation force of the outer cap to the inner cap; and a locking unit formed between the outer cap and the vessel inlet, for locking the outer cap when the inner cap is mounted at the vessel inlet.

Advantageous Effects

The child-resistant cap according to the present invention having the above structure and operations has the advantage in that since the sealing member removing unit is installed in the inner cap, if the pressing plate of the sealing member removing unit is firstly pressed and then the cap is opened, the sealing member is automatically removed from the vessel inlet. Accordingly, the usage convenience is enhanced.

In addition, the child-resistant cap according to the present invention has the advantage in that since the sealing member is automatically removed by the sealing member removing unit, a sanitary problem caused when a user's hand comes in contact with the vessel inlet in order to remove the sealing member can be solved.

In addition, the child-resistant cap according to the present invention has the advantage in that since the outer cap can maintain an upwardly moved position from the inner cap by the elastic member formed at the outer cap, the first hooking protrusion of the inner cap can be separated from the second hooking protrusion of the outer cap. Accordingly, even if a child rotates the outer cap, the rotation force of the outer cap is not transmitted to the inner cap and thus the child can be more effectively protected.

In addition, the child-resistant cap according to the present invention has the advantage in that since an inclined surface is formed between the first hooking protrusion and the second hooking protrusion, even if a child rotates the outer cap, the second hooking protrusion slides on the inclined surface of the first hooking protrusion. Accordingly, the rotation force of the outer cap is not transmitted to the inner cap, and thus the child can be more effectively protected.

In addition, the child-resistant cap according to the present invention has the advantage in that since the sealing member removing unit formed at the inner cap is protected by the protection plate formed at the upper surface of the outer cap, the sealing member removing unit is prevented from being operated by an external force when exposed outwardly.

In addition, the child-resistant cap according to the present invention has the advantage in that since a hole having a certain size is formed at the sealing member by partially removing the sealing member by the sealing member removing unit, contents stored in the vessel is discharged outwardly little by little through the hole. Accordingly, even if the child drinks the contents stored in the vessel, a little amount of the contents is provided to the child and thus the child can be protected from the contents.

In addition, the child-resistant cap according to the present invention has the advantage in that a hole of a certain shape is formed at the sealing member by the sealing member punching unit formed at the inner cap, and the hole can be variously constructed according to a kind of the contents stored in the vessel. Accordingly, the child can be more safely protected.

BRIEF DESCRIPTION OF THE DRAWINGS

FIG. 3 is a sectional view of a child-resistant cap according to a first embodiment of the present invention;

FIG. 4 is a perspective view of an inner cap of the child-resistant cap according to a first embodiment of the present invention;

FIG. 5 is a cut-perspective view of an outer cap of the child-resistant cap according to a first embodiment of the present invention;

FIG. 6 is a lateral view of a rotation force transmitting portion of the child-resistant cap according to a first embodiment of the present invention;

FIG. 7 is a perspective view of a cutter of a sealing member removing unit of the child-resistant cap according to a first embodiment of the present invention;

FIG. 8 is a perspective view of a hooking portion of the sealing member removing unit of the child-resistant cap according to a first embodiment of the present invention;

FIGS. 9 and 10 are views showing an operation state of the child-resistant cap according to the present invention;

FIG. 11 is a sectional view of a child-resistant cap according to a second embodiment of the present invention;

FIG. 12 is a sectional view taken along line B-B of FIG. 11;

FIG. 13 is a sectional view taken along line C-C of FIG. 11;

FIG. 14 is a view showing an operation state of a child-resistant cap according to a second embodiment of the present invention;

FIG. 15 is a perspective view of a child-resistant cap according to a third embodiment of the present invention;

FIGS. 18 and 19 are views showing an operation state of the child-resistant cap according to a third embodiment of the present invention;

FIG. 20 is a sectional view of a child-resistant cap according to a fourth embodiment of the present invention;

FIGS. 21 and 22 are views showing an operation state of the child-resistant cap according to a fourth embodiment of the present invention;

FIG. 23 is a perspective view of a child-resistant cap according to a fifth embodiment of the present invention;

FIG. 24 is a sectional view of the child-resistant cap according to a fifth embodiment of the present invention;

FIGS. 25 and 26 are views showing an operation state of the child-resistant cap according to a fifth embodiment of the present invention;

FIG. 27 is a sectional view of a child-resistant cap according to a sixth embodiment of the present invention;

FIG. 28 is a sectional view of a child-resistant cap according to a seventh embodiment of the present invention;

FIG. 29 is a view showing an operation state of the child-resistant cap according to a seventh embodiment of the present invention;

FIG. 30 is a perspective view of a child-resistant cap according to an eighth embodiment of the present invention;

FIG. 31 is a sectional view of the child-resistant cap according to an eighth embodiment of the present invention;

FIG. 32 is a perspective view of a cutter of a sealing member removing unit of the child-resistant cap according to the eighth embodiment of the present invention;

FIG. 33 is a perspective view of a hooking portion of the sealing member removing unit of the child-resistant cap according to eighth embodiment of the present invention;

FIGS. 34 to 36 are views showing an operation state of the child-resistant cap according to the eighth embodiment of the present invention;

FIG. 37 is a sectional view of a child-resistant cap according to a ninth embodiment of the present invention;

FIGS. 38 to 40 are views showing examples of a punch of a child-resistant cap according to the ninth of the present invention; and FIG. 41 is a view showing an operation state of the child-resistant cap according to the ninth embodiment of the present invention;

MODE FOR INVENTION

Figure 1:
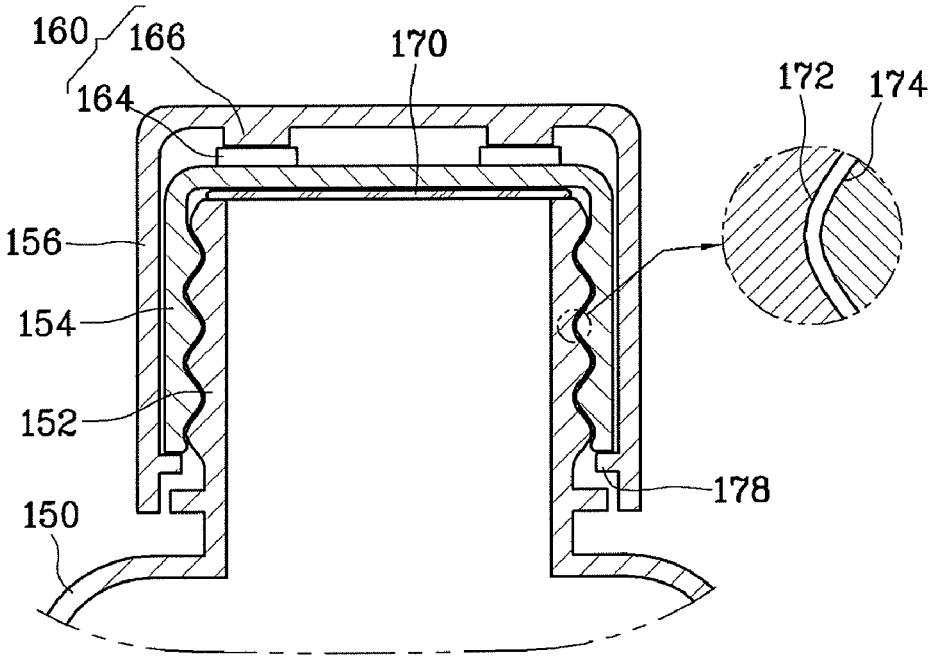
FIG. 1 Prior Art
FIG. 1 is a sectional view showing a child-resistant cap in accordance with the conventional art.
Figure 2:
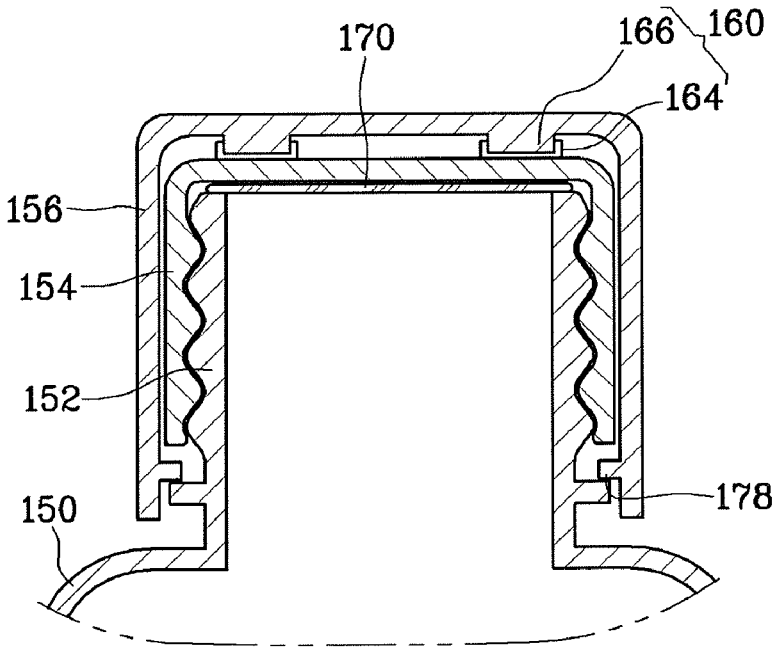
FIG. 2 Prior Art
FIG. 2 is a view showing an operation state of the child-resistant cap in accordance with the conventional art.

Hereinafter, a child-resistant cap according to the present invention will be explained in more detail with reference to the attached drawings.

FIG. 3 is a sectional view of a child-resistant cap according to a first embodiment of the present invention, FIG. 4 is a perspective view of an inner cap of the child-resistant cap according to a first embodiment of the present invention, and FIG. 5 is a cut-perspective view of an outer cap of the child-resistant cap according to a first embodiment of the present invention.

The child-resistant cap according to a first embodiment of the present invention comprises an inner cap 14 mounted at a vessel inlet 12 through which contents stored in a vessel 10 is discharged outwardly; an outer cap 16 disposed at an outer circumferential surface of the inner cap 14 so as to perform an idling with the inner cap 14; a rotation force transmitting portion 18 disposed between the inner cap 14 and the outer cap 16 for transmitting a rotation force of the outer cap 16 to the inner cap 14 only when the outer cap 16 is downwardly moved with a force more than a certain degree; and a sealing member removing unit 22 formed at the inner cap 14 for removing a sealing member 20 sealed at the vessel inlet 12 when the inner cap 14 is detached from the vessel inlet 12, and storing the removed sealing member 20 in the inner cap 14.

The vessel 10 stores contents that do harm to a child such as a poisonous drug, a detergent, a domestic medicine, etc. The sealing member 20 for protecting the contents stored in the vessel 10 by sealing the vessel inlet 12 is attached to the vessel inlet 12 through which the contents inside the vessel 10 is discharged outwardly. The sealing member 20 is formed of paper or an aluminum thin plate that can be easily removed by a knife, etc.

The inner cap 14 has a cylindrical shape of which upper and lower ends are opened, and is provided with the sealing member removing unit 22 therein. A female screw portion 26 screw-coupled to a male screw portion 24 formed at an outer circumferential surface of the vessel inlet 12 is formed at a lower inner circumferential surface. Also, an adhesion portion 28 for adhering an upper end of the vessel inlet 12 is protruding from an upper inner circumferential surface of the female screw portion 26 in a circumferential direction. A separation preventing jaw 30 for preventing the inner cap 14 from being separated from the outer cap 16 is protruding from a lower outer circumferential surface of the inner cap 14.

The outer cap 16 is inserted into the inner cap 14 so as to be movable in upper and lower directions, and has a cylindrical shape of which upper and lower ends are opened. A plurality of convexo-concave protrusions 32 to facilitate to rotate the outer cap 16 by a user's hand are formed at an outer circumferential surface of the outer cap 16, and a separation preventing protrusion 34 locked by the separation preventing jaw 30 of the inner cap 14 is protruding from a lower inner circumferential surface of the outer cap 16.

A separation preventing protrusion 36 for preventing the inner cap 14 from being separated towards the upper side of the outer cap 16 is formed at an upper end of the outer cap 16. Also, an elastic member 38 supported at an upper surface of the inner cap 14 and maintaining a moved state of the outer cap 16 towards the upper side of the inner cap 14 is formed at the separation preventing protrusion 36.

The elastic member 38 is formed of a thin film spontaneously curved and generating a certain elastic force, and an end thereof is supported by an upper surface of the inner cap 14. The elastic member 38 provides an elastic force to the outer cap 16 so that the outer cap 16 can maintain an upwardly moved state.

When the outer cap 16 is downwardly pushed, the elastic member 38 is elastically transformed and the outer cap 16 is downwardly moved. When the force applied to the outer cap 16 is removed, the outer cap 16 is upwardly moved by the elastic force of the elastic member 38 thereby to be restored to the original position.

As shown in FIGS. 4 and 5, the rotation force transmitting portion 18 comprises a first hooking protrusion 40 protruding at a lower outer circumferential surface of the inner cap 14 in a circumferential direction with the same gap and with a certain width; and a second hooking protrusion 42 protruding at an inner circumferential surface of the outer cap 16 in a circumferential direction with the same gap and with a certain width, and inserted between the first hooking protrusions 40 when the outer cap 16 is downwardly pressed thus to be locked by the first hooking protrusion 40.

The first hooking protrusion 40 is formed at an outer circumferential surface of the inner cap 14 with the same gap, and an inclined surface 46 having a certain inclination angle is formed at an upper end of the first hooking protrusion 40. When the second hooking protrusion 42 is inserted into the first hooking protrusion 40 to some degree, the second hooking protrusion 42 can slide on the inclined surface 46.

The second hooking protrusion 42 is formed at an inner circumferential surface of the outer cap 16 with the same gap, and the same inclined surface 48 as that of the first hooking protrusion 42 is formed at a lower end of the second hooking protrusion 42. When the inclined surface 48 comes in contact with the inclined surface 46 of the first hooking protrusion 40, the second hooking protrusion 42 slides on the inclined surface 46.

As shown in FIG. 6, when the outer cap 16 is pressed by a child, the elastic force by the elastic member 38 is applied to the outer cap 16 and thus the outer cap 16 is not completely pressed. Therefore, the second hooking protrusion 42 of the outer cap 16 is not completely inserted into the first hooking protrusion 40 of the inner cap 14, and thus the inclined surface 48 of the second hooking protrusion 42 slides on the inclined surface 46 of the first hooking protrusion even if the outer cap 16 is rotated. As the result, the rotation force of the outer cap 16 is not transmitted to the inner cap 14 thereby to prevent the cap from being opened.

The sealing member removing unit 22 comprises a pressing plate 50 disposed in the inner cap 14 so as to be movable in upper and lower directions and pressed by a user, a cutter 52 formed at an edge of a lower surface of the pressing plate 50 in a circumferential direction for penetrating the sealing member 20 when the pressing plate 50 is pressed and cutting the sealing member 20 when the cap is rotated, a hooking portion 54 downwardly protruding at the lower surface of the pressing plate 50 for locking the sealing member 20 so that the sealing member 20 cut by the cutter 52 can be received in the inner cap 14, and a connection portion 56 formed between an outer circumferential surface of the pressing plate 50 and an inner circumferential surface of the inner cap 14 for guiding the pressing plate 50 to be movable in upper and lower directions and maintaining a moved position of the pressing plate 50 by its elastic force.

The pressing plate 50 is formed as a disc shape having a diameter smaller than an inner diameter of the inner cap 14, and is preferably disposed at a position lower than an upper surface of the inner cap 14.

As shown in FIG. 7, the cutter 52 comprises a plurality of supporting portions 60 formed at an edge of a lower surface of the pressing plate 50 with the same gap, a first cutting portion 62 sharply formed at a lower end of the supporting portion 60 and downwardly moved when the pressing plate 50 is pressed for penetrating the sealing member 20, and a second cutting portion 64 formed on at least one side surface of both side surfaces of the supporting portion 60 for cutting the sealing member 20 as a circular shape with being rotated under a contact state to an inner circumferential surface of the vessel inlet 12 when the inner cap 14 is rotated.

As shown in FIG. 8, the hooking portion 54 comprises a supporting rod 66 extending from a lower surface of the pressing plate 50 with a certain length for penetrating the sealing member 20, and at least one hooking protrusion 68 formed at a lateral surface of the supporting rod 66 for stopping the sealing member 20 so that the sealing member 20 cut by the cutter 52 can be stored in the inner cap 14.

The supporting rod 66 is formed as a bar type extending towards a lower direction of the pressing plate 50, and a punch portion 70 for penetrating the sealing member 20 is sharply formed at an end of the supporting rod 66.

The hooking protrusion 68 is formed to be elastically transformed, and is upwardly bent at the time of penetrating the sealing member 20 thereby to pass through a hole formed by the punch portion 70 and to be inserted into the sealing member 20. Then, the hooking protrusion 68 is extended into the original state after being positioned at an inner side of the sealing member 20 thereby to be hooked at the inner surface of the sealing member 20.

At least one hooking protrusion 68 is perpendicularly extending from both side surfaces of the supporting rod 66 with a certain length. The connection portion 56 is formed between an outer circumferential surface of the pressing plate 50 and an inner circumferential surface of the inner cap 14 as a thin film having a dome shape.

The connection portion 56 is elastically transformed when the pressing plate 50 is pressed by a force more than a certain degree, thereby guiding the pressing plate 50 to be moved in a lower direction.

The connection portion 56 elastically maintains a current position of the pressing plate 50. That is, when the pressing plate 50 is upwardly protruding, the connection portion 56 has a convex dome shape and maintains the current state of the pressing plate 50. However, when the pressing plate 50 is pressed by a force more than a certain degree, the connection portion 56 is elastically transformed into a concave shape and maintains the pressed state of the pressing plate 50.

An operation of the child-resistant cap according to the present invention will be explained.

FIGS. 9 and 10 are views showing an operation of the child-resistant cap according to the present invention.

When the pressing plate 50 formed at the inner cap 14 is downwardly pressed in order to discharge the contents stored in the vessel 10 outwardly, the connection portion 56 is elastically transformed and the pressing plate 50 is downwardly moved. Then, the first cutting portion 62 of the cutters 52 formed at a lower surface of the pressing plate 50 penetrates an edge of the sealing member 20, and the supporting rod 66 of the hooking portion 54 penetrates a center of the sealing member 20.

At the time of penetrating the sealing member 20, the hooking protrusion 68 of the hooking portion 54 is upwardly bent thus to pass through a hole penetrated by the punch portion 70 of the supporting rod 66. Once the hooking protrusion 68 is positioned at an inner surface of the sealing member 20, it is elastically transformed into the original state as an extended state.

Then, when the outer cap 16 is downwardly moved by a user's hand with a force more than a certain degree, the elastic member 38 is elastically transformed. As the result, the second hooking protrusion 42 formed at the outer cap 16 is inserted between the first hooking protrusions 40 formed at the inner cap 14 thereby to be engaged with each other. Also, when the outer cap 16 is rotated, the rotation force of the outer cap 16 is transmitted to the inner cap 14, and thus the inner cap 14 is separated from the vessel inlet 12 with being rotated.

Herein, the cutter 52 is rotated under a contact state to an inner circumferential surface of the vessel inlet 12, and the second cutting portion 64 formed at both side surfaces of the supporting portion 60 cuts the sealing member 20 as a circular shape. Since the sealing member 20 that has been removed from the vessel inlet 12 is locked by the hooking protrusion 68 of the hooking portion 54, it is detached from the vessel inlet 12 together with the inner cap 14 thus to be stored in the inner cap 14.

If the contents stored in the vessel 10 of which sealing member 20 has been removed is discharged outwardly through the vessel inlet 12 and then the cap is mounted at the vessel inlet 12 again, the outer cap 16 is moved towards the upper side of the inner cap 14 and the first hooking protrusion 40 is spaced from the second hooking protrusion 42. Accordingly, even if a child rotates the outer cap 16, the rotation force of the outer cap 16 is not transmitted to the inner cap 14.

Also, even if the child downwardly moves the outer cap 16, the outer cap 16 is not completely moved downwardly due to the weak force by the elastic force of the elastic member 38. Under the state, even if the outer cap 16 is rotated, the inclined surface 48 of the second hooking protrusion 42 slides on the inclined surface 46 of the first stopping protrusion 40 and thus the inner cap 14 is not opened.

FIG. 11 is a sectional view of a child-resistant cap according to a second embodiment of the present invention, FIG. 12 is a sectional view taken along line B-B of FIG. 11, and FIG. 13 is a sectional view taken along line C-C of FIG. 11.

The child-resistant cap according to a second embodiment of the present invention comprises: an inner cap 80 mounted at a vessel inlet 12 of a vessel 10 through which contents stored in the vessel 10 is discharged outwardly; an outer cap 82 disposed at an outer circumferential surface of the inner cap 80 so as to be movable in upper and lower directions; a spline portion 85 formed between an outer circumferential surface of the inner cap 80 and an inner circumferential surface of the outer cap 82 for transmitting a rotation force of the outer cap 82 to the inner cap 80; a locking unit 84 formed between the outer cap 82 and the vessel inlet 12, for locking the outer cap 82 when the inner cap 80 is mounted at the vessel inlet 12; and a sealing member removing unit 22 formed at the inner cap 80 for removing the sealing member 20 sealed at the vessel inlet 12 when the inner cap 80 is detached from the vessel inlet 12, and storing the removed sealing member 20 in the inner cap 80.

The inner cap 80 has a cylindrical shape of which upper and lower ends are opened, and is provided with the sealing member removing unit 22 therein. A female screw portion 88 screw-coupled to a male screw portion 86 formed at an outer circumferential surface of the vessel inlet 12 is formed at a lower inner circumferential surface of the inner cap 80.

The outer cap 16 has a cylindrical shape of which upper and lower ends are opened, and stoppers 90 and 92 for preventing the inner cap 80 from being separated are respectively formed at the upper and lower ends. A plurality of convexo-concave protrusions 94 to facilitate to rotate the outer cap 16 by a user's hand are formed at an outer circumferential surface of the outer cap 16.

The spline portion 85 comprises a first hooking protrusion 81 formed at an outer circumferential surface of the inner cap 80 in a circumferential direction with the same gap, and a second hooking protrusion 83 formed at an inner circumferential surface of the outer cap 82 in a circumferential direction with the same gap and gear-engaged with the first hooking protrusion 81.

As shown in FIG. 13, the locking unit 84 comprises a first locking protrusion 98 formed at an edge of a flange portion 96 in a circumferential direction with the same gap, the flange portion 96 extending from an outer circumferential surface of a lower surface of the vessel inlet 12 as a disc shape; and a second locking protrusion 100 formed at an inner circumferential surface of a lower end of the outer cap 82 with the same gap and inserted into the first locking protrusion 98 thus to be locked.

The first locking protrusion 98 is formed to have a gear shape, and is provided with an inclined surface 102 having a certain inclination angle at one side thereof. The second locking protrusion 100 has the same inclined surface 104 as the inclined surface 102 of the first locking protrusion 98 at a surface facing the inclined surface 102 of the first locking protrusion 98.

When the outer cap 82 is rotated thus to be downwardly moved, the second locking protrusion 100 formed at the outer cap 82 is inserted into the first locking protrusion 98 formed at the vessel inlet 12. Herein, if the inner cap 80 does not completely cover the vessel inlet 12, the inclined surface 104 of the second locking protrusion 100 slides on the inclined surface 102 of the first locking protrusion 98 thus to be rotated. On the contrary, if the inner cap 80 completely covers the vessel inlet, the second locking protrusion 100 is inserted between the first locking protrusions 98 and thus the outer cap 82 is prevented from being rotated.

The sealing member removing unit 22 has the same construction and operation as that aforementioned in the first embodiment, and thus its detail explanation will be omitted.

An operation of the child-resistant cap according to the second embodiment of the present invention will be explained.

FIG. 14 is a view showing an operation state of a child-resistant cap according to a second embodiment of the present invention.

When the outer cap 82 is upwardly pulled, the outer cap 82 is slid on the outer circumferential surface of the inner cap 80 and is upwardly moved. Herein, the second locking protrusion 100 formed at the outer cap 82 is detached from the first locking protrusion 98 formed at the vessel inlet 12, and thus the locked state of the outer cap 82 is released.

Under the state, if the outer cap 82 is rotated, the inner cap 80 spline-coupled to the outer cap 82 is together rotated and is detached from the vessel inlet 12.

Herein, the sealing member 20 sealed at the vessel inlet 12 is removed by the sealing member removing unit 22, and is stored in the inner cap 80.

Then, if the inner cap 80 is mounted at the vessel inlet 12 again, the second locking protrusions 100 formed at the inner circumferential surface of the outer cap 82 are inserted into the first locking protrusions 98 formed at the vessel inlet 12. Accordingly, the outer cap 82 is locked and thus is not opened by a child.

Figure 16:
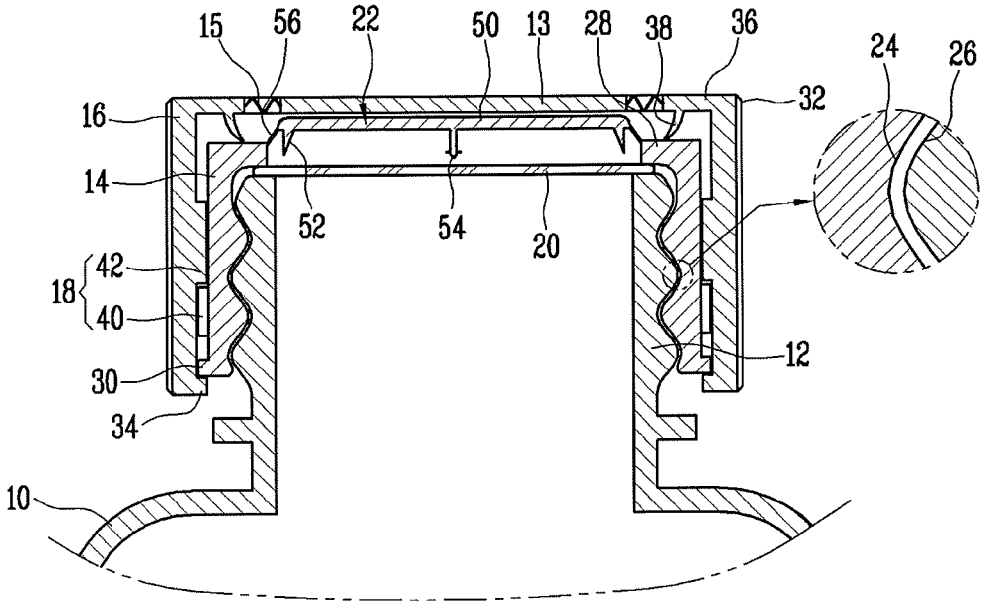
FIG. 16 is a sectional view of the child-resistant cap according to a third embodiment of the present invention.
Figure 17:
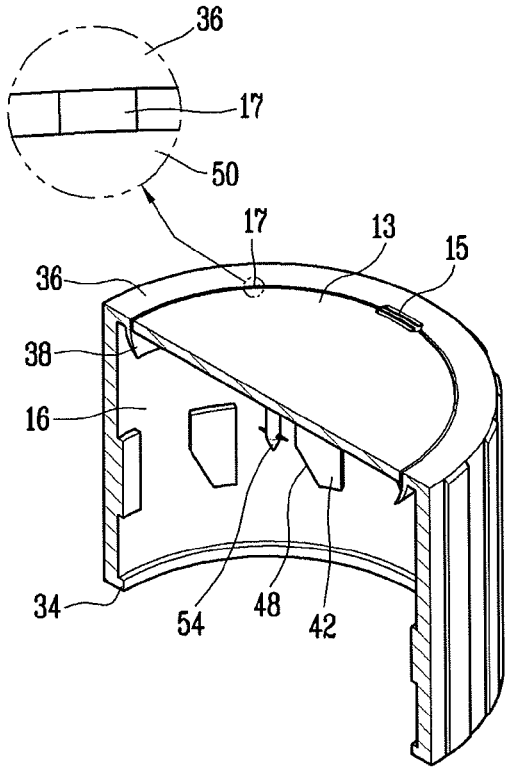
FIG. 17 is a perspective view of an inner cap of the child-resistant cap according to a third embodiment of the present invention.

FIG. 15 is a perspective view of a child-resistant cap according to a third embodiment of the present invention, FIG. 16 is a sectional view of the child-resistant cap according to a third embodiment of the present invention, and FIG. 17 is a perspective view of an inner cap of the child-resistant cap according to a third embodiment of the present invention.

The child-resistant cap according to a third embodiment of the present invention comprises: an inner cap 14 mounted at a vessel inlet 12 of a vessel 10 through which contents stored in the vessel 10 is discharged outwardly; an outer cap 16 disposed at an outer circumferential surface of the inner cap 14 so as to perform an idling with the inner cap 14; a rotation force transmitting portion 18 formed between the inner cap 14 and the outer cap 16 for transmitting a rotation force of the outer cap 16 to the inner cap 14 only when the outer cap 16 is downwardly moved by a force more than a certain degree; a sealing member removing unit 22 formed at the inner cap 14 for removing a sealing member 20 sealed at the vessel inlet 12 when the inner cap 14 is detached from the vessel inlet 12, and storing the removed sealing member 20 in the inner cap 14; and a protection plate 13 movably mounted at an upper surface of the outer cap 16 for protecting the sealing member removing unit 22 mounted at the inner cap 14.

The inner cap 14 and the outer cap 16 have the same construction and operation as those aforementioned in the first embodiment, and thus their detail explanation will be omitted.

The protection plate 13 is formed at an upper inner circumferential surface of the outer cap 16 with a certain gap as a disc shape. Also, a plurality of connection ribs 17 cut when the protection plate 13 is downwardly moved and maintaining a fixed state of the protection plate 13 to the outer cap 16 are formed between the outer circumferential surface of the protection plate 13 and the upper inner circumferential surface of the outer cap 16.

The connection ribs 17 is formed to be cut when a certain force is applied thereto, and guides the protection plate 13 to be downwardly moved when the protection plate 13 is pressed with being cut.

A plurality of guide ribs 15 are connected between an outer circumferential surface of the protection plate 13 and an upper inner circumferential surface of the outer cap 16 with a certain gap, thereby guiding the protection plate 13 to be downwardly moved under a connected state to the outer cap 16.

The guide rib 15 is formed to have an 'S' shape, and has one end connected to the inner circumferential surface of the outer cap 16 and another end connected to the outer circumferential surface of the protection plate 13. When the protection plate 13 is downwardly moved, the guide rib 15 is extended thereby to guide the protection plate 13 to be downwardly moved and to maintain the connected state of the protection plate 13 to the outer cap 16. The guide rib 15 is inserted into an insertion groove 21 formed at the outer circumferential surface of the protection plate 13.

A connection belt 19 having a thin thickness is formed at the 'S'-curved portion of the guide rib 15, so that the guide rib 15 maintains the 'S'-shape. The connection belt 19 is cut when the protection plate 13 is downwardly moved.

The protection plate 13 protects the sealing member removing unit 22 from an external force by preventing the sealing member removing unit 22 from being exposed outwardly. When the protection plate 13 is downwardly pressed by a user in order to operate the sealing member removing unit 22, the connection rib 17 connected between the protection plate 13 and the outer cap 16 is cut, the protection plate 13 is downwardly moved, and a pressing plate 50 of the sealing member removing unit 22 is pressed. Herein, the guide rib 15 having an 'S' shape and connected between the protection plate 13 and the outer cap 16 is extended, thereby guiding the protection plate 13 to be downwardly moved and maintaining the connected state of the protection plate 13 to the outer cap 16.

The rotation force transmitting portion 18 comprises a first hooking protrusion 40 protruding from a lower outer circumferential surface of the inner cap 14 in a circumferential direction with the same gap and with a certain width; and a second hooking protrusion 42 protruding from an inner circumferential surface of the outer cap 16 in a circumferential direction with the same gap and with a certain width, and engaged with the first hooking protrusions 40 when the outer cap 16 is downwardly pressed.

The first hooking protrusion 40 and the second hooking protrusion 42 have the same construction as those aforementioned in the first embodiment, and thus their detail explanation will be omitted.

The sealing member removing unit 22 comprises a pressing plate 50 disposed in the inner cap 14 so as to be movable in upper and lower directions; a cutter 52 formed at an outer edge of a lower surface of the pressing plate 50 for penetrating the sealing member 20 when the pressing plate 50 is pressed and cutting the sealing member 20 when the cap is rotated; a hooking portion 54 downwardly protruding at a lower surface of the pressing plate 50 for hooking the sealing member 20 so that the sealing member 20 cut by the cutter 52 can be stored in the inner cap 14 and a connection portion 56 formed between an outer circumferential surface of the pressing plate 50 and an inner circumferential surface of the inner cap 14 for guiding the pressing plate 50 to be movable in upper and lower directions and maintaining a moved position of the pressing plate 50 by its elastic force.

The sealing member removing unit 22 has the same construction and operation as that aforementioned in the first embodiment, and thus its detail explanation will be omitted.

An operation of the child-resistant cap according to the third embodiment of the present invention will be explained.

FIGS. 18 and 19 are views showing an operation state of the child-resistant cap according to a third embodiment of the present invention.

When the protection plate 13 connected to the outer cap 16 is pressed by a user in order to discharge the contents stored in the vessel 10 outwardly, the connection rib 17 connected between the protection plate 13 and the outer cap 16 is cut, and the protection plate 13 is downwardly moved thereby to press the pressing plate 50 of the sealing member removing unit 22. Herein, the guide rib 15 having an 'S' shape and connected between the protection plate 13 and the outer cap 16 is extended thereby to guide the protection plate 13 to be downwardly moved and to maintain the connected state of the protection plate 13 to the outer cap 16.

Then, when the pressing plate 50 is downwardly moved by the protection plate 13, the connection portion 56 is elastically transformed. Then, the first cutting portion 62 of the cutters 52 formed at a lower surface of the pressing plate 50 penetrates an edge of the sealing member 20, and the supporting rod 66 of the hooking portion 54 penetrates a center of the sealing member 20.

At the time of penetrating the sealing member 20, the hooking protrusion 68 of the hooking portion 54 is upwardly bent thus to pass through a hole penetrated by the punch portion 70 of the supporting rod 66. Once the hooking protrusion 68 is positioned at an inner surface of the sealing member 20, it is elastically transformed into the original state as an extended state.

Then, when the outer cap 16 is downwardly moved by a user's hand with a force more than a certain degree, the elastic member 38 is elastically transformed. As the result, the second hooking protrusion 42 formed at the outer cap 16 is inserted between the first hooking protrusions 40 formed at the inner cap 14 thereby to be engaged with each other. Also, when the outer cap 16 is rotated, the rotation force of the outer cap 16 is transmitted to the inner cap 14, and thus the inner cap 14 is separated from the vessel inlet 12 with being rotated.

Herein, the cutter 52 is rotated under a contact state to an inner circumferential surface of the vessel inlet 12, and the second cutting portion 64 formed at both side surfaces of the supporting portion 60 cuts the sealing member 20 as a circular shape. Since the sealing member 20 that has been removed from the vessel inlet 12 is locked by the hooking protrusion 68 of the hooking portion 54, it is detached from the vessel inlet 12 together with the inner cap 14 thus to be stored in the inner cap 14.

If the contents stored in the vessel 10 of which sealing member 20 has been removed is discharged outwardly through the vessel inlet 12 and then the cap is mounted at the vessel inlet 12 again, the outer cap 16 is moved towards the upper side of the inner cap 14 by the elastic force of the elastic member 38 and the first hooking protrusion 40 is spaced from the second hooking protrusion 42. Accordingly, even if a child rotates the outer cap 16, the rotation force of the outer cap 16 is not transmitted to the inner cap 14.

Also, even if the child downwardly moves the outer cap 16, the outer cap 16 is not completely moved downwardly due to the weak force by the elastic force of the elastic member 38. Under the state, even if the outer cap 16 is rotated, the inclined surface 48 of the second hooking protrusion 42 slides on the inclined surface 46 of the first stopping protrusion 40 and thus the inner cap 14 is not opened.

FIG. 20 is a sectional view of a child-resistant cap according to a fourth embodiment of the present invention.

The child-resistant cap according to a fourth embodiment of the present invention comprises: an inner cap 80 mounted at a vessel inlet 12 of a vessel 10 through which contents stored in the vessel 10 is discharged outwardly; an outer cap 82 disposed at an outer circumferential surface of the inner cap 80 so as to be movable in upper and lower directions; a spline portion 85 formed between an outer circumferential surface of the inner cap 80 and an inner circumferential surface of the outer cap 82 for transmitting a rotation force of the outer cap 82 to the inner cap 80; a locking unit 84 formed between the outer cap 82 and the vessel inlet 12, for locking the outer cap 82; a sealing member removing unit 22 formed at the inner cap 80 for removing the sealing member 20 sealed at the vessel inlet 12 when the inner cap 80 is detached from the vessel inlet 12, and storing the removed sealing member 20 in the inner cap 80; and a protection plate 13 mounted at an upper surface of the outer cap 82 so as to be downwardly movable for protecting the sealing member removing unit 22 mounted at the inner cap 80.

The inner cap 80 has a cylindrical shape of which upper and lower ends are opened, and is provided with the sealing member removing unit 22 therein. A female screw portion 88 screw-coupled to a male screw portion 86 formed at an outer circumferential surface of the vessel inlet 12 is formed at a lower inner circumferential surface of the inner cap 80.

The outer cap 82 has a cylindrical shape of which upper and lower ends are opened, and stoppers 90 and 92 for preventing the inner cap 80 from being separated are respectively formed at the upper and lower ends. A plurality of convexo-concave protrusions 94 to facilitate to rotate the outer cap 82 by a user's hand are formed at an outer circumferential surface of the outer cap 82.

The protection plate 13 is formed at an upper inner circumferential surface of the outer cap 82 with a certain gap as a disc shape. Since the protection plate 13 has the same construction as that aforementioned in the third embodiment, its detail explanation will be omitted.

The spline portion 85 comprises a first hooking protrusion 81 formed at an outer circumferential surface of the inner cap 80 in a circumferential direction with the same gap, and a second hooking protrusion 83 formed at an inner circumferential surface of the outer cap 82 in a circumferential direction with the same gap and gear-engaged with the first hooking protrusion 81.

The locking unit 84 comprises a first locking protrusion 98 formed at an edge of a flange portion 96 in a circumferential direction with the same gap, the flange portion 96 extending from an outer circumferential surface of a lower surface of the vessel inlet 12 as a disc shape; and a second locking protrusion 100 formed at an inner circumferential surface of a lower end of the outer cap 82 with the same gap and inserted into the first locking protrusion 98 thus to be locked.

The first locking protrusion 98 and the second locking protrusion 100 of the locking unit 84 have the same structure and operation as those aforementioned in the second embodiment, and thus their detail explanation will be omitted.

The sealing member removing unit 22 has the same structure and operation as those aforementioned in the first embodiment, and thus their detail explanation will be omitted.

An operation of the child-resistant cap according to a fourth embodiment of the present invention will be explained.

FIGS. 21 and 22 are views showing an operation of the child-resistant cap according to a fourth embodiment of the present invention.

When the protection plate 13 is downwardly pressed, the sealing member removing unit 22 penetrates the sealing member 20 sealed at the vessel inlet 12 as afore-mentioned in the first embodiment.

Then, when the outer cap 82 is upwardly pulled, the outer cap 82 is slid on the outer circumferential surface of the inner cap 80 and is upwardly moved. Herein, the second locking protrusion 100 formed at the outer cap 82 is detached from the first locking protrusion 98 formed at the vessel inlet 12, and thus the locked state of the outer cap 82 is released.

Under the state, if the outer cap 82 is rotated, the inner cap 80 spline-coupled to the outer cap 82 is together rotated and is detached from the vessel inlet 12.

Herein, the sealing member 20 sealed at the vessel inlet 12 is removed by the sealing member removing unit 22, and is stored in the inner cap 80.

Then, if the inner cap 80 is mounted at the vessel inlet 12 again, the second locking protrusions 100 formed at the inner circumferential surface of the outer cap 82 are inserted into the first locking protrusions 98 formed at the vessel inlet 12. Accordingly, the outer cap 82 is locked and thus is not opened by a child.

FIG. 23 is a perspective view of a child-resistant cap according to a fifth embodiment of the present invention, and FIG. 24 is a sectional view of the child-resistant cap according to a fifth embodiment of the present invention.

The child-resistant cap according to a fifth embodiment of the present invention comprises an inner cap 14 mounted at a vessel inlet 12 through which contents stored in a vessel 10 is discharged outwardly; an outer cap 16 disposed at an outer circumferential surface of the inner cap 14 so as to perform an idling with the inner cap 14; a rotation force transmitting portion 18 disposed between the inner cap 14 and the outer cap 16 for transmitting a rotation force of the outer cap 16 to the inner cap 14 only when the outer cap 16 is downwardly moved with a force more than a certain degree; and a sealing member removing unit 22 formed at the outer cap 16 for removing a sealing member 20 sealed at the vessel inlet 12 and storing the removed sealing member 20 in the inner cap 14.

The inner cap 14 has a cylindrical shape of which upper and lower ends are opened. A female screw portion 26 screw-coupled to a male screw portion 24 formed at an outer circumferential surface of the vessel inlet 12 is formed at a lower inner circumferential surface of the inner cap 14. Also, an adhesion portion 28 for adhering an upper end of the vessel inlet 12 is protruding from an upper inner circumferential surface of the female screw portion 26 in a circumferential direction. A separation preventing jaw 30 for preventing the inner cap 14 from being separated from the outer cap 16 is protruding from a lower outer circumferential surface of the inner cap 14.

The outer cap 16 is inserted into the inner cap 14 so as to be movable in upper and lower directions, and has a cylindrical shape of which upper and lower ends are opened. A plurality of convexo-concave protrusions 32 to facilitate to rotate the outer cap 16 by a user's hand are formed at an outer circumferential surface of the outer cap 16, and a separation preventing protrusion 34 locked by the separation preventing jaw 30 of the inner cap 14 is protruding from a lower inner circumferential surface of the outer cap 16.

A separation preventing protrusion 36 for preventing the inner cap 14 from being separated towards the upper side of the outer cap 16 is extending at an upper inner circumferential surface of the outer cap 16 as a ring shape. Also, an elastic member 38 supported at an upper surface of the inner cap 14 and maintaining a moved state of the outer cap 16 towards the upper side of the inner cap 14 is formed at a lower surface of the separation preventing protrusion 36. The sealing member removing unit 22 is formed at an inner circumferential surface of the separation preventing protrusion 36.

The elastic member 38 is formed of a thin film spontaneously curved and generating a certain elastic force, and an end thereof is supported by an upper surface of the inner cap 14. The elastic member 38 provides an elastic force to the outer cap 16 so that the outer cap 16 can maintain an upwardly moved state.

When the outer cap 16 is downwardly pushed, the elastic member 38 is elastically transformed and the outer cap 16 is downwardly moved. When the force applied to the outer cap 16 is removed, the outer cap 16 is upwardly moved by the elastic force of the elastic member 38 thereby to be restored to the original position.

The rotation force transmitting portion 18 has the same construction and operation as that aforementioned in the first embodiment, and thus its detail explanation will be omitted.

The sealing member removing unit 22 comprises a pressing plate 50 fixed at an upper inner circumferential surface of the outer cap 16 and downwardly moved with the locked state being released when pressed by a certain force; a plurality of cutters 52 formed at an outer edge of a lower surface of the pressing plate 50 in a circumferential direction for penetrating the sealing member 20 when the pressing plate 50 is pressed and cutting the sealing member 20 when the cap is rotated; a hooking portion 54 downwardly protruding at a lower surface of the pressing plate 50 for hooking the sealing member 20 so that the sealing member 20 cut by the cutter 52 can be stored in the outer cap 16; and a locking rib 200 formed between an outer circumferential surface of the pressing plate 50 and an inner circumferential surface of the outer cap 16 for maintaining a fixed state of the pressing plate 50 to an inner circumferential surface of the outer cap 16 and releasing the locked state of the pressing plate 50 with being cut when the pressing plate 50 is pressed.

The pressing plate 50 is disposed at an upper inner circumferential surface of the outer cap 16 with a certain gap. The pressing plate 50 is formed as a disc shape having a diameter almost the same as an inner diameter of the outer cap 16, and is disposed at an inner circumferential surface of the outer cap 16 so as to be movable in upper and lower directions.

The locking rib 200 is connected between an outer circumferential surface of the pressing plate 50 and an inner circumferential surface of the outer cap 16 for maintaining a fixed state of the pressing plate 50 to the outer cap 16 and releasing the locked state of the pressing plate 50 to the outer cap 16 with being cut when the pressing plate 50 is pressed by a force more than a certain degree.

The locking rib 200 is formed as a thin film that can be cut when a certain force is applied thereto, and is cut when the pressing plate 50 is pressed by a force more than a certain degree thereby to guide the pressing plate 50 to be downwardly moved.

A plurality of guide ribs 202 are connected between an outer circumferential surface of the pressing plate 50 and an inner circumferential surface of the outer cap 16 with a certain gap, thereby guiding the pressing plate 50 to be downwardly moved under a connected state to the outer cap 16 when the pressing plate 50 is downwardly moved.

The guide rib 202 is formed to have an 'S'-shape, and has one end connected to the inner circumferential surface of the outer cap 16 and another end connected to the outer circumferential surface of the pressing plate 50. When the pressing plate 50 is downwardly moved, the guide rib 202 is extended thereby to guide the pressing plate 50 to be downwardly moved and to maintain the connected state of the pressing plate 50 to the outer cap 16.

The guide rib 202 is disposed in a state of being inserted into an insertion groove 204 formed at the outer circumferential surface of the pressing plate 50 and an insertion groove 206 formed at the inner circumferential surface of the outer cap 16.

A connection belt 208 having a thin thickness is formed between the two insertion grooves 204 and 206 and the curved portion of the guide rib 202, so that the guide rib 202 maintains the 'S'-shape. The connection belt 208 is cut when the pressing plate 50 is downwardly moved.

A lift supporting portion 210 for guiding the pressing plate 50 to be perpendicularly moved in the outer cap 16 and rotating the pressing plate 50 with the outer cap 16 when the outer cap 16 is rotated is formed between the pressing plate 50 and the outer cap 16.

The lift supporting portion 210 comprises at least one guide groove 212 perpendicularly formed at an edge of a lower surface of the outer cap 16 towards a lower direction, and at least one guide protrusion 214 formed at the outer circumferential surface of the pressing plate 50 and inserted into the guide groove 212 thus to be moved along the guide groove 212 in upper and lower directions.

When the pressing plate 50 is downwardly moved, the guide protrusion 214 formed at the outer circumferential surface of the pressing plate 50 is moved along the guide groove 212 formed at the inner circumferential surface of the outer cap 16 in upper and lower directions. Therefore, the lift supporting portion 210 guides the pressing plate 50 to be perpendicularly moved towards a lower direction, and transmits a rotation force of the outer cap 16 to the pressing plate 50 when the outer cap 16 is rotated thereby to rotate the pressing plate 50.

The cutter 54 and the hooking portion 54 have the same construction and operation as those aforementioned in the first embodiment, and thus their detail explanation will be omitted.

An operation of the child-resistant cap according to a fifth embodiment of the present invention will be explained.

FIGS. 25 and 26 are views showing an operation of the child-resistant cap according to the fifth embodiment of the present invention.

When the pressing plate 50 connected to the outer cap 16 is downwardly pressed by a user in order to discharge the contents stored in the vessel 10 outwardly, the locking rib 200 connected between the pressing plate 50 and the outer cap 16 is cut, and the pressing plate 50 is downwardly moved. Herein, the guide rib 202 having an 'S'shape and connected between the pressing plate 50 and the outer cap 16 is extended thereby to guide the pressing plate 50 to be downwardly moved and to maintain the connected state of the pressing plate 50 to the outer cap 16.

When the pressing plate 50 is downwardly moved, the first cutting portion 62 of the cutters 52 formed at a lower surface of the pressing plate 50 penetrates an edge of the sealing member 20, and the supporting rod 66 of the hooking portion 54 penetrates a center of the sealing member 20.

At the time of penetrating the sealing member 20, the hooking protrusion 68 of the hooking portion 54 is upwardly bent thus to pass through a hole penetrated by the punch portion 70 of the supporting rod 66. Once the hooking protrusion 68 is positioned at an inner surface of the sealing member 20, it is elastically transformed into the original state as an extended state.

Then, when the outer cap 16 is downwardly moved by a user's hand with a force more than a certain degree, the elastic member 38 is elastically transformed and the outer cap 16 is moved. As the result, the second hooking protrusion 42 formed at the outer cap 16 is inserted between the first hooking protrusions 40 formed at the inner cap 14 thereby to be engaged with each other. Also, when the outer cap 16 is rotated, the rotation force of the outer cap 16 is transmitted to the inner cap 14, and thus the inner cap 14 is separated from the vessel inlet 12 with being rotated.

Herein, the rotation force of the outer cap 16 is transmitted to the pressing plate 50 by the lift supporting portion 210, and thus the pressing plate 50 is rotated together with the outer cap 16. When the pressing plate 50 is rotated, the cutter 52 is rotated under a contact state to the inner circumferential surface of the vessel inlet 12, and the second cutting portion 64 formed at both side surfaces of the supporting portion 60 cuts the sealing member 20 as a circular shape. Since the sealing member 20 that has been removed from the vessel inlet 12 is locked by the hooking protrusion 68 of the hooking portion 54, it is detached from the vessel inlet 12 together with the inner cap 14 thus to be stored in the inner cap 14.

If the contents stored in the vessel 10 of which sealing member 20 has been removed is discharged outwardly through the vessel inlet 12 and then the cap is mounted at the vessel inlet 12 again, the outer cap 16 is moved towards the upper side of the inner cap 14 by the elastic force of the elastic member 38 and the first hooking protrusion 40 is spaced from the second hooking protrusion 42. Accordingly, even if a child rotates the outer cap 16, the rotation force of the outer cap 16 is not transmitted to the inner cap 14.

Also, even if the child downwardly moves the outer cap 16, the outer cap 16 is not completely moved downwardly due to the weak force by the elastic force of the elastic member 38. Under the state, even if the outer cap 16 is rotated, the inclined surface 48 of the second hooking protrusion 42 slides on the inclined surface 46 of the first stopping protrusion 40 and thus the inner cap 14 is not opened.

FIG. 27 is a sectional view of a child-resistant cap according to a sixth embodiment of the present invention.

The child-resistant cap according to the sixth embodiment has the same construction as that of the fifth embodiment except a rotation force transmitting portion.

More concretely, a rotation force transmitting portion 250 according to the sixth embodiment of the present invention comprises a first hooking protrusion 252 radially disposed at an upper surface of the inner cap 14 with a certain gap and upwardly protruding with a certain width, and a second hooking protrusion 254 radially disposed at an inner surface of the separation preventing protrusion 36 formed at an upper inner surface of the outer cap 16 with a certain gap and downwardly protruding with a certain width thus to be locked by the first hooking protrusion 252.

Since the second hooking protrusion 254 is provided with an inclined surface, the first hooking protrusion 252 is slid on an inclined surface of the second hooking protrusion 254 when the outer cap 16 is rotated. As the result, the rotation force of the outer cap 16 is not transmitted to the inner cap 14. Also, when the outer cap 16 is rotated with a downwardly pressed state, the first hooking protrusion 252 is locked by the second hooking protrusion 254 and thus the rotation force of the outer cap 16 is transmitted to the inner cap 14. As the result, the inner cap 14 is rotated and the cap is detached from the vessel 10.

FIG. 28 is a sectional view of a child-resistant cap according to a seventh embodiment of the present invention, and FIG. 29 is a view showing an operation state of the child-resistant cap according to a seventh embodiment of the present invention.

The child-resistant cap according to the seventh embodiment of the present invention comprises an inner cap 14 mounted at a vessel inlet 12 of a vessel 10 through which contents stored in the vessel 10 is discharged outwardly; an outer cap 16 disposed at an outer circumferential surface of the inner cap 14 so as to perform an idling with the inner cap 14; a rotation force transmitting portion 18 formed between the inner cap 14 and the outer cap 16 for transmitting a rotation force of the outer cap 16 to the inner cap 14 only when the outer cap 16 is downwardly moved by a force more than a certain degree; a sealing member removing unit 22 formed at the inner cap 14 for removing a sealing member 20 sealed at the vessel inlet 12 when the inner cap 14 is detached from the vessel inlet 12, and storing the removed sealing member 20 in the inner cap 14; and a protection plate 300 movably mounted at an upper surface of the outer cap 16 for protecting the sealing member removing unit 22 mounted at the inner cap 14.

The inner cap, the outer cap, and the rotation force transmitting portion have the same construction as those aforementioned in the first embodiment, and thus their detail explanation will be omitted. As the rotation force transmitting portion 18, not only the rotation force transmitting portion 18 aforementioned in the first embodiment but also the rotation force transmitting portion 80 of the sixth embodiment can be applied.

The protection plate 300 is formed at an upper inner circumferential surface of the outer cap 16 with a certain gap as a disc shape. Also, a connection portion 302 for connecting the protection plate 300 to an inner circumferential surface of the outer cap 16, guiding the protection plate 300 to be movable in upper and lower directions, and maintaining a moved position of the protection plate 300 by its elastic force is formed between an outer circumferential surface of the protection plate 300 and an upper inner circumferential surface of the outer cap 16.

The connection portion 302 is formed between an outer circumferential surface of the protection plate 300 and an inner circumferential surface of the inner cap 14 as a thin film having a dome shape. The connection portion 302 is elastically transformed when the protection plate 300 is pressed by a force more than a certain degree, thereby guiding the protection plate 300 to be moved in a lower direction.

The connection portion 302 elastically maintains a current position of the protection plate 300. That is, when the protection plate 300 is upwardly protruding, the connection portion 302 has a convex dome shape and maintains the current state of the protection plate 300. However, when the protection plate 300 is pressed by a force more than a certain degree, the connection portion 302 is elastically transformed into a concave shape and maintains a downwardly moved state of the protection plate 300.

The sealing member removing unit 22 comprises a pressing plate 50 fixed at an upper inner circumferential surface of the inner cap 14 and downwardly moved with the locked state being released when pressed by a certain force; a plurality of cutters 52 formed at an outer edge of a lower surface of the pressing plate 50 in a circumferential direction for penetrating the sealing member 20 when the pressing plate 50 is pressed and cutting the sealing member 20 when the cap is rotated; a hooking portion 54 downwardly protruding at a lower surface of the pressing plate 50 for hooking the sealing member 20 so that the sealing member 20 cut by the cutter 52 can be stored in the inner cap 14 and a locking rib 17 connected between an outer circumferential surface of the pressing plate 50 and an inner circumferential surface of the inner cap 14 for maintaining a fixed state of the pressing plate 50 to an inner circumferential surface of the inner cap 14 and releasing the locked state of the pressing plate 50 with being cut when the pressing plate 50 is pressed.

The sealing member removing unit 22 according to the seventh embodiment has the same construction as the sealing member removing unit 22 of the fifth embodiment except that the pressing plate 50 is connected to the inner circumferential surface of the inner cap 14, and thus its detail explanation will be omitted.

In the child-resistant cap according to the seventh embodiment of the present invention, when the protection plate 300 is pressed, the connection portion 302 is elastically transformed and thus the protection plate 300 is downwardly moved. As the result, the pressing plate 50 disposed at a lower surface of the protection plate 300 is downwardly moved thereby to remove the sealing member 29 and to store the removed sealing member 29 in the inner cap 14. Herein, the sealing member removing unit 22 has the same operation as that aforementioned in the fifth embodiment, and thus its detail explanation will be omitted.

FIG. 30 is a perspective view of a child-resistant cap according to an eighth embodiment of the present invention, and FIG. 31 is a sectional view of the child-resistant cap according to an eighth embodiment of the present invention.

The child-resistant cap according to the eighth embodiment of the present invention comprises an inner cap 14 mounted at a vessel inlet 12 of a vessel 10 through which contents stored in the vessel 10 is discharged outwardly; an outer cap 16 disposed at an outer circumferential surface of the inner cap 14 so as to perform an idling with the inner cap 14; a rotation force transmitting portion 18 formed between the inner cap 14 and the outer cap 16 for transmitting a rotation force of the outer cap 16 to the inner cap 14 only when the outer cap 16 is downwardly moved by a force more than a certain degree; a sealing member removing unit 22 formed at the inner cap 14 for partially removing a sealing member 20 when the inner cap 14 is detached from the vessel inlet 12 so that the contents stored in the vessel can be discharged outwardly little by little, and storing the removed sealing member 20 in the inner cap 14.

The inner cap 14 has a cylindrical shape of which upper and lower ends are opened, and is provided with the sealing member removing unit 22 therein. A female screw portion 26 screw-coupled to a male screw portion 24 formed at an outer circumferential surface of the vessel inlet 12 is formed at a lower inner circumferential surface of the inner cap 14. Also, an adhesion portion 28 for adhering an upper end of the vessel inlet 12 is protruding from an upper inner circumferential surface of the female screw portion 26 in a circumferential direction. A separation preventing jaw 30 for preventing the inner cap 14 from being separated from the outer cap 16 is protruding from a lower outer circumferential surface of the inner cap 14.

The outer cap 16 is inserted into the inner cap 14 so as to be movable in upper and lower directions, and has a cylindrical shape of which upper and lower ends are opened. A separation preventing protrusion 36 for preventing the inner cap 14 from being separated towards the upper side of the outer cap 16 is formed at an upper end of the outer cap 16. Also, an elastic member 38 supported at an upper surface of the inner cap 14 and maintaining a moved state of the outer cap 16 towards the upper side of the inner cap 14 is formed at the separation preventing protrusion 36.

The elastic member 38 has the same structure as the elastic member aforementioned in the third embodiment, and thus its detail explanation will be omitted.

A protection plate 13 for protecting the sealing member removing unit formed at the inner cap is formed at an upper surface of the outer cap.

The protection plate 13 has the same structure as the protection plate aforementioned in the third embodiment, and thus its detail explanation will be omitted.

The rotation force transmitting portion 18 has the same structure as the rotation force transmitting portion aforementioned in the third embodiment protection plate aforementioned in the third embodiment, and thus its detail explanation will be omitted.

The sealing member removing unit 22 partially removes the sealing member 20 sealed at the vessel inlet 12, and stores the removed sealing member 20 in the inner cap 14. That is, a small hole is formed at the sealing member 20 so that the contents stored in the vessel 10 can be discharged outwardly little by little. When a child drinks the contents stored in the vessel 10 under a state that the cap is opened, the contents stored in the vessel 10 is outwardly discharged little by little and thus the child is protected.

The sealing member removing unit 22 comprises a pressing plate 350 disposed in the inner cap 14 so as to be movable in upper and lower directions, and downwardly moved by the protection plate 13 when the protection plate 13 is pressed by a user; a cutter 352 formed near the center of a lower surface of the pressing plate 350 in a circumferential direction with the same gap for penetrating the sealing member 20 when the pressing plate 350 is pressed and partially cutting the sealing member 20 when the cap is rotated; a hooking portion 354 downwardly protruding at the lower surface of the pressing plate 350 for locking the sealing member 20 so that the sealing member 20 cut by the cutter 352 can be received in the inner cap 14; and a connection portion 356 formed between an outer circumferential surface of the pressing plate 350 and an inner circumferential surface of the inner cap 14, for guiding the pressing plate 350 to be movable in upper and lower directions and maintaining a moved position of the pressing plate 350 by its elastic force.

The pressing plate 350 is formed as a disc shape having a diameter smaller than an inner diameter of the inner cap 14.

FIG. 32 is a perspective view of a cutter of a sealing member removing unit of the child-resistant cap according to the eighth embodiment of the present invention.

As shown in FIG. 32, the cutter 352 comprises a supporting portion 360 formed at a lower surface of the pressing plate 350 in a circumferential direction with the same gap, a first cutting portion 362 sharply formed at a lower end of the supporting portion 360 and downwardly moved when the pressing plate 350 is pressed for penetrating the sealing member 20, a second cutting portion 364 formed on at least one side surface of both side surfaces of the supporting portion 360 for cutting the sealing member 20 as a circular shape when the inner cap 14 is rotated, and a receiving portion 365 concaved at a front surface of the supporting portion 360 with a certain width in a perpendicular direction for receiving the edge of the removed sealing member 20.

As shown in FIG. 33, the hooking portion 354 comprises a supporting rod 366 extending from a lower surface of the pressing plate 350 with a certain length for penetrating the sealing member 20, and a plurality of hooking protrusions 368 formed at a lateral surface of the supporting rod 366 in a circumferential direction for stopping the sealing member 20 so that the sealing member 20 cut by the cutter 352 can be stored in the inner cap 14.

The supporting rod 366 is formed as a bar type extending towards a lower direction of the pressing plate 350, and a punch portion 370 for penetrating the sealing member 20 is sharply formed at an end of the supporting rod 366.

Preferably, four hooking protrusions 368 are extending from a circumferential surface of the supporting rod 366 with an angle of 90°.

The connection portion 356 is formed between an outer circumferential surface of the pressing plate 350 and an inner circumferential surface of the inner cap 14 as a thin film having a dome shape. The connection portion 356 is elastically transformed when the pressing plate 350 is pressed by a force more than a certain degree, thereby guiding the pressing plate 350 to be moved in a lower direction.

The connection portion 356 elastically maintains a current position of the pressing plate 350. That is, when the pressing plate 350 is upwardly protruding, the connection portion 356 has a convex dome shape and maintains the current state of the pressing plate 350. However, when the pressing plate 350 is pressed by a force more than a certain degree, the connection portion 356 is elastically transformed into a concave shape and maintains the pressed state of the pressing plate 350.

An operation of the child-resistant cap according to the present invention will be explained.

FIGS. 34 to 36 are views showing an operation state of the child-resistant cap according to the eighth embodiment of the present invention.

When the protection plate 13 connected to the outer cap 16 is downwardly pressed by a user in order to discharge the contents stored in the vessel 10 outwardly, the connection rib 17 connected between the protection plate 13 and the outer cap 16 is cut, and the protection plate 13 is downwardly moved thereby to press the pressing plate 50 of the sealing member removing unit 22. Herein, the guide rib 15 having an 'S'shape and connected between the protection plate 13 and the outer cap 16 is extended thereby to guide the protection plate 13 to be downwardly moved and to maintain the connected state of the protection plate 13 to the outer cap 16.

When the pressing plate 350 is downwardly moved by the protection plate 13, the connection portion 356 is elastically transformed and the pressing plate 350 is downwardly moved. Then, the first cutting portion 362 of the cutters 352 formed at a lower surface of the pressing plate 350 penetrates a part of the sealing member 20, and the supporting rod 366 of the hooking portion 354 penetrates a center of the sealing member 20.

At the time of penetrating the sealing member 20, the hooking protrusion 368 of the hooking portion 354 is upwardly bent thus to pass through a hole penetrated by the punch portion 370 of the supporting rod 366. Once the hooking protrusion 368 is positioned at an inner surface of the sealing member 20, it is elastically transformed into the original state as an extended state.

Then, when the outer cap 16 is downwardly moved by a user's hand with a force more than a certain degree, the elastic member 38 is elastically transformed and the outer cap 16 is moved. As the result, the second hooking protrusion 42 formed at the outer cap 16 is inserted between the first hooking protrusions 40 formed at the inner cap 14 thereby to be engaged with each other. Also, when the outer cap 16 is rotated, the rotation force of the outer cap 16 is transmitted to the inner cap 14, and thus the inner cap 14 is separated from the vessel inlet 12 with being rotated.

Herein, the cutter 352 is rotated under a contact state to an inner circumferential surface of the vessel inlet 12, and the second cutting portion 364 formed at both side surfaces of the supporting portion 360 partially cuts the sealing member 20 as a circular shape thereby to form a hole 380 at the sealing member 20. Since the edge of the sealing member 20 that has been removed from the vessel inlet 12 is received in the receiving portion 365 formed at the supporting portion 360 and the center of the sealing member 20 is locked by the hooking protrusion 368 of the hooking portion 354, the sealing member 20 is detached from the vessel inlet 12 together with the inner cap 14 thus to be stored in the inner cap 14.

Since the portion of the sealing member 20 cut by the sealing member removing unit 22 is the small hole 380, when a child drinks the contents stored in the vessel 10 under a state that the cap is opened, the contents is slowly discharged through the hole 380. Accordingly, an amount of the contents to be provided to the child is reduced, and thus stability can be obtained.

If the contents stored in the vessel 10 of which sealing member 20 has been removed is discharged outwardly through the vessel inlet 12 and then the cap is mounted at the vessel inlet 12 again, the outer cap 16 is moved towards the upper side of the inner cap 14 by the elastic force of the elastic member 38 and the first hooking protrusion 40 is spaced from the second hooking protrusion 42. Accordingly, even if a child rotates the outer cap 16, the rotation force of the outer cap 16 is not transmitted to the inner cap 14.

Also, even if the child downwardly moves the outer cap 16, the outer cap 16 is not completely moved downwardly due to the weak force by the elastic force of the elastic member 38. Under the state, even if the outer cap 16 is rotated, the inclined surface 48 of the second hooking protrusion 42 slides on the inclined surface 46 of the first stopping protrusion 40 and thus the inner cap 14 is not opened.

FIG. 37 is a sectional view of a child-resistant cap according to a ninth embodiment of the present invention.

The cap according to the ninth embodiment has the same construction as the cap of the eighth embodiment except that a sealing member punching unit 400 for punching the sealing member 20 is formed instead of the sealing member removing unit 22 of the eighth embodiment.

The child-resistant cap according to the ninth embodiment of the present invention comprises: an inner cap 14 mounted at a vessel inlet 12 of a vessel 10 through which contents stored in the vessel 10 is discharged outwardly; an outer cap 16 disposed at an outer circumferential surface of the inner cap 14 so as to be perform an idling with the inner cap 14; a rotation force transmitting portion 18 formed between the inner cap 14 and the outer cap 16 for transmitting a rotation force of the outer cap 16 to the inner cap 14 only when the outer cap 16 is downwardly moved by a force more than a certain degree; and a punching unit 400 formed at the inner cap 14 and punching the sealing member removing unit as a hole having a certain shape for discharging the contents stored in the vessel little by little and thus protecting a child.

The inner cap 14, the outer cap 16, and the rotation force transmitting portion 18 have the same construction and operation as those aforementioned in the eighth embodiment, and thus their detail explanation will be omitted.

The sealing member punching unit 400 comprises a pressing plate 402 disposed in the inner cap 14 so as to be movable in upper and lower directions and downwardly moved by the protection plate 13 when the protection plate 13 is pressed, a punch 404 formed at a center of a lower surface of the pressing plate 402 for forming a hole of a certain shape at the sealing member 20 when the pressing plate 402 is pressed, and a connection portion 406 connected between an outer circumferential surface of the pressing plate 402 and an inner circumferential surface of the inner cap 14 for guiding the pressing plate 402 to be moved in upper and lower directions and supporting a moved position of the pressing plate 610 by its elastic force.

The pressing plate 402 is formed as a disc shape having a diameter smaller than an inner diameter of the inner cap 14.

FIGS. 38 to 40 are views showing examples of a punch of a child-resistant cap according to the ninth of the present invention.

As shown in FIG. 38, the punch 404 comprises a supporting rod 410 perpendicularly extending from the lower surface of the pressing plate 402 so as to have a certain diameter, and a punching portion 412 having a conical shape and formed at the end of the supporting rod 620 for penetrating the sealing member 20 and forming a circular hole 420.

The punch 404 is downwardly moved when the pressing plate 402 is pressed thus to form the hole 420 at the sealing member 20, so that the contents stored in the vessel 10 can be discharged outwardly through the hole 420.

The reason why the hole 420 is formed at the sealing member 20 is in order to prevent the contents stored in the vessel 10 from being discharged out at one time by discharging the contents little by little through the hole 420. Accordingly, when a child drinks the contents stored in the vessel 10 under a state that the cap is opened by mistake, a little amount of the contents is provided to the child and thereby the child is protected.

The punch 404 can have various forms according to a kind of the contents stored in the vessel 10.

That is, the first punch 404 has a conical shape at an end thereof, and is preferably applied when the material stored in the vessel 10 is a liquid material such as edible oil, shampoo, etc. or a liquid material having a certain concentration.

When the material stored in the vessel 10 is a solid material having a certain size, a hole having a cross shape is formed at the sealing member 20 in order to discharge the material stored in the vessel 10 outwardly one by one. That is, as shown in FIG. 39, a second punch 416 comprises a rod portion 418 perpendicularly extending from the lower surface of the pressing plate 402 and having a sectional surface of a cross shape, and a punching portion 422 sharply formed at the end of the rod portion 418 for penetrating the sealing member 20.

The second punch 416 forms a hole of a cross shape at the sealing member 20. Therefore, the solid material stored in the vessel 10 such as a pill, etc. is hooked at the hole thus to be discharged out one by one, so that a child can be more safely protected.

As shown in FIG. 40, a third punch 430 is applied when the material stored in the vessel 10 is a powder-type material, and has a plurality of pins 432 at the lower surface of the pressing plate 402. That is, the third punch 430 is constructed so that the powder stored in the vessel 10 can be slowly discharged out through a plurality of minute holes formed at the sealing member 20 when the vessel 10 is shaken.

The punch can have various forms according to a kind of the material stored in the vessel besides the aforementioned forms.

The connection portion 406 has the same construction and operation as that aforementioned in the eighth embodiment, and thus its detail explanation will be omitted.

An operation of the child-resistant cap according to the ninth embodiment of the present invention will be explained.

FIG. 41 is a view showing an operation state of the child-resistant cap according to the ninth embodiment of the present invention.

When the protecting plate 13 connected to the outer cap 16 is downwardly pressed in order to discharge the contents stored in the vessel 10 outwardly, the connection portion 17 connected between the protection plate 13 and the outer cap 16 is cut, and the protection plate 13 is downwardly moved thereby to press the pressing plate 402 of the sealing member removing unit 22. Herein, the guide rib 15 having an 'S'shape and connected between the protection plate 13 and the outer cap 16 is extended thereby to guide the protection plate 13 to be downwardly moved and to maintain the connected state of the protection plate 13 to the outer cap 16.

Then, when the pressing plate 402 is downwardly moved by the protection plate 13, the connection portion 406 is elastically transformed and the pressing plate 402 is downwardly moved. Then, the punch 404 formed at the lower surface of the pressing plate 402 penetrates the sealing member 20 thereby to form a hole at the sealing member 20.

At the time of penetrating the sealing member 20, the punch 404 forms the hole 420 having a certain shape at a certain portion of the sealing member 20.

Then, when the outer cap 16 is downwardly moved by a user's hand with a force more than a certain degree, the elastic member 38 is elastically transformed and the outer cap 16 is moved. As the result, the second hooking protrusion 42 formed at the outer cap 16 is inserted between the first hooking protrusions 40 formed at the inner cap 14 thereby to be engaged with each other. Also, when the outer cap 16 is rotated, the rotation force of the outer cap 16 is transmitted to the inner cap 14, and thus the inner cap 14 is separated from the vessel inlet 12 with being rotated.

Since the hole 20 is formed at the sealing member 20 by the sealing member punching unit 400, the contents stored in the vessel 10 is slowly discharge out. Accordingly, even if a child drinks the contents stored in the vessel 10 by mistake, a little amount of the contents is provided to the child and thus the child can be protected.

The invention claimed is:

1. A child-resistant cap, comprising:

an inner cap mounted at a vessel inlet of a vessel;

an outer cap disposed at an outer circumferential surface of the inner cap so as to perform an idling with the inner cap;

a rotation force transmitting portion disposed between the inner cap and the outer cap for transmitting a rotation force of the outer cap to the inner cap only when the outer cap is downwardly moved with a force more than a certain degree; and a sealing member removing unit formed at the inner cap for removing a sealing member sealed at the vessel inlet when the inner cap is detached from the vessel inlet, and storing the removed sealing member in the inner cap, wherein upper and lower ends are opened, a female screw portion screw-coupled to a male screw portion formed at an outer circumferential surface of the vessel inlet is formed at a lower inner circumferential surface of the inner cap, a separation preventing jaw for preventing the inner cap from being separated from the outer cap is protruding at a lower outer circumferential surface of the inner cap.

2. A child-resistant cap, comprising:

an inner cap mounted at a vessel inlet of a vessel;

an outer cap disposed at an outer circumferential surface of the inner cap so as to perform an idling with the inner cap;

a rotation force transmitting portion disposed between the inner cap and the outer cap for transmitting a rotation force of the outer cap to the inner cap only when the outer cap is downwardly moved with a force more than a certain degree; and a sealing member removing unit formed at the inner cap for removing a sealing member sealed at the vessel inlet when the inner cap is detached from the vessel inlet, and storing the removed sealing member in the inner cap, wherein the outer cap is inter-fitted with the inner cap so as to be movable in upper and lower directions, and has upper and lower ends that are opened, a plurality of convexo-concave protrusions to facilitate rotating the outer cap by a user's hand are formed at an outer circumferential surface of the outer cap, and a separation preventing protrusion locked by the inner cap is protruding from a lower inner circumferential surface of the outer cap.

3. The cap of claim 2, wherein an elastic member supported at an upper surface of the inner cap and maintaining a moved state of the outer cap towards an upper side of the inner cap is formed at an upper end of the outer cap.

4. The cap of claim 3, wherein the elastic member is formed of a thin film spontaneously curved and generating a certain elastic force.

5. A child-resistant cap, comprising:

an inner cap mounted at a vessel inlet of a vessel;

an outer cap disposed at an outer circumferential surface of the inner cap so as to perform an idling with the inner cap;

a rotation force transmitting portion disposed between the inner cap and the outer cap for transmitting a rotation force of the outer cap to the inner cap only when the outer cap is downwardly moved with a force more than a certain degree; and a sealing member removing unit formed at the inner cap for removing a sealing member sealed at the vessel inlet when the inner cap is detached from the vessel inlet, and storing the removed sealing member in the inner cap, wherein the rotation force transmitting portion comprises:

a first hooking protrusion protruding from a lower outer circumferential surface of the inner cap in a circumferential direction with a gap therebetween and at a given width; and a second hooking protrusion protruding from an inner circumferential surface of the outer cap in a circumferential direction, and inserted into the first hooking protrusions thereby to be engaged with the first hooking protrusions when the outer cap is downwardly pressed.

6. The cap of claim 5, wherein an inclined surface having a certain inclination angle is formed at an upper end of the first hooking protrusion.

7. The cap of claim 6, wherein the second hooking protrusion has the same inclined surface as the inclined surface of the first hooking protrusion at a surface facing the inclined surface of the first hooking protrusion.

8. A child-resistant cap, comprising:

an inner cap mounted at a vessel inlet of a vessel;

an outer cap disposed at an outer circumferential surface of the inner cap so as to perform an idling with the inner cap;

a rotation force transmitting portion disposed between the inner cap and the outer cap for transmitting a rotation force of the outer cap to the inner cap only when the outer cap is downwardly moved with a force more than a certain degree; and a sealing member removing unit formed at the inner cap for removing a sealing member sealed at the vessel inlet when the inner cap is detached from the vessel inlet, and storing the removed sealing member in the inner cap, wherein the sealing member removing unit comprises:

a pressing plate disposed in the inner cap so as to be movable in upper and lower directions;

at least one cutter formed at an edge of a lower surface of the pressing plate in a circumferential direction for penetrating the sealing member when the pressing plate is pressed and cutting the sealing member when the inner cap is rotated;

a hooking portion downwardly protruding at a lower surface of the pressing plate for storing the sealing member cut by the cutter in the inner cap and a connection portion formed between an outer circumferential surface of the pressing plate and an inner circumferential surface of the inner cap and elastically transformed so that the pressing plate can be movable in upper and lower directions, wherein the pressing plate is formed as a disc shape having a diameter smaller than an inner diameter of the inner cap, and is disposed at a position lower than an upper surface of the inner cap.

9. The cap of claim 8, wherein the cutter comprises:

a plurality of supporting portions formed at an edge of a lower surface of the pressing plate;

a first cutting portion sharply formed at a lower end of the supporting portion and penetrating the sealing member when the pressing plate is pressed; and a second cutting portion formed on at least one side surface of the side surfaces of the supporting portion for cutting the sealing member as a circular shape when the inner cap is rotated.

10. The cap of claim 8, wherein the hooking portion comprises:

a supporting rod extending from a lower surface of the pressing plate in a perpendicular direction and having a punch portion to penetrate the sealing member at an end thereof; and a hooking protrusion extending from an outer circumferential surface of the supporting rod with a certain length in a perpendicular direction, passing through a hole formed by the supporting rod as an upwardly bent state at the time of penetrating the sealing member, and extended into an original state after being positioned at an inner side of the sealing member thus to be hooked at the inner side of the sealing member.

11. The cap of claim 8, wherein the connection portion is formed between an outer circumferential surface of the pressing plate and an inner circumferential surface of the inner cap as a thin film having a dome shape, and is elastically transformed when the pressing plate is pressed by a force more than a certain degree.

* * * * *